US011027543B2

(12) United States Patent
Moriya et al.

(10) Patent No.: US 11,027,543 B2
(45) Date of Patent: Jun. 8, 2021

(54) PRINTING APPARATUS AND METHOD OF DETERMINING MINIMUM DISCHARGE ENERGY

(71) Applicant: CANON KABUSHIKI KAISHA, Tokyo (JP)

(72) Inventors: Takatsugu Moriya, Tokyo (JP); Masaki Oikawa, Inagi (JP); Nobuyuki Hirayama, Fujisawa (JP); Hiroyasu Nomura, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/701,420

(22) Filed: Dec. 3, 2019

(65) Prior Publication Data

US 2020/0180308 A1 Jun. 11, 2020

(30) Foreign Application Priority Data

Dec. 6, 2018 (JP) ..... JP2018-229207

(51) Int. Cl.
*B41J 2/045* (2006.01)
*B41J 2/14* (2006.01)

(52) U.S. Cl.
CPC ..... *B41J 2/04563* (2013.01); *B41J 2/0458* (2013.01); *B41J 2/14153* (2013.01)

(58) Field of Classification Search
CPC ... B41J 2/04563; B41J 2/14153; B41J 2/0458
See application file for complete search history.

(56) References Cited

U.S. PATENT DOCUMENTS

2010/0194810 A1* 8/2010 Takabayashi ..... B41J 2/0451 347/14
2012/0062631 A1* 3/2012 Aoki ..... B41J 2/04553 347/10
2015/0015632 A1* 1/2015 Sakurai ..... B41J 2/14129 347/14
2020/0180308 A1* 6/2020 Moriya ..... B41J 2/0451
2020/0338884 A1* 10/2020 Nakano ..... B41J 2/04581

FOREIGN PATENT DOCUMENTS

JP 2005231175 A * 9/2005
JP 2011-189708 A 9/2011
WO WO-2018017054 A1 * 1/2018 ..... B41J 2/04563

* cited by examiner

*Primary Examiner* — Julian D Huffman
(74) *Attorney, Agent, or Firm* — Canon U.S.A., Inc. IP Division

(57) ABSTRACT

A printing apparatus measures a temperature of an electrothermal transducer by a corresponding temperature detection element, detects, based on the measured temperature, a peak voltage which indicates a point of change, from a state where ink is discharged normally from a printhead to a state where the ink is not discharged from the printhead, and compares the peak voltage with a threshold value. The measurement, detection, and comparison are repeated until the peal voltage becomes equal to or more than the threshold value. Energy supplied to the electrothermal transducer at a time in which the peak voltage is determined to be equal to or more than the threshold is determined to be minimum discharge energy.

18 Claims, 13 Drawing Sheets

PRINTING APPARATUS AND METHOD OF DETERMINING MINIMUM DISCHARGE ENERGY

BACKGROUND

Field

The present disclosure relates to a printing apparatus and a method of determining minimum discharge energy, and particularly to, for example, a printing apparatus in which a printhead incorporating an element substrate that includes a plurality of print elements to perform printing in accordance with an inkjet method and a method of determining minimum discharge energy determination.

Description of the Related Art

As a method of discharging ink from an inkjet printhead (to be referred to as a printhead hereinafter) used in an inkjet printing apparatus (to be referred to as a printing apparatus hereinafter), there is a thermal inkjet method which uses the bubbling force of ink by heating the ink to cause film boiling. A printhead used in the thermal inkjet method includes an element substrate on which orifices for discharging ink, a pressure chamber communicating with the orifices, a fluid channel that supplies the ink to the pressure chamber, and a supply port that supplies the ink to the fluid channel are formed. Heat generating resistive elements (heaters) are formed in the pressure chamber of the element substrate, and ink is discharged from the orifices by the discharge energy generated by the heat generating resistive elements.

In the thermal inkjet method as described above, discharge failure may occur if the discharge energy is too small and the ink cannot bubble normally. Also, the lifetime of the printhead may be shortened if the discharge energy is too large and the heaters are damaged by the excessive energy. Hence, ink discharging by the printhead needs to be performed by using an appropriate amount of discharge energy. As a method of measuring an appropriate amount of discharge energy, there is proposed a method of measuring the minimum ink-dischargeable energy and using the energy obtained by multiplying the energy by a predetermined coefficient.

As this measurement method, Japanese Patent Laid-Open No. 2011-189708 proposes a method of determining a discharge condition by arranging, on each print element, a temperature detection element formed by a thin film resistor via an insulation film and detecting the temperature information of each nozzle to measure the minimum dischargeable energy from the state of the temperature change.

SUMMARY

It has now been determined that the above-described related art is problematic in that it requires accurate measurement of the minute temperature change between 0.5° C. to 1.0° C. and the S/N ratio tends to decrease due to the influence of external disturbance. For example, when the minimum dischargeable energy is to be measured, it is difficult to accurately measure the minute temperature change because the temperature will fall during the measurement operation even if the temperature of the element substrate has risen immediately after printing.

Accordingly, the present disclosure is devised as a response to the above-described disadvantages of the related art.

For example, a printing apparatus and a method of determining minimum discharge energy according to the present disclosure are capable of determining the minimum discharge energy of a printhead while suppressing the influence of external disturbance.

According to one aspect of the present disclosure, there is provided a printing apparatus that performs printing by discharging ink onto a print medium from a printhead which includes a plurality of electrothermal transducers, a plurality of temperature detection elements configured to detect temperatures of corresponding electrothermal transducers, and a plurality of orifices arranged in correspondence with the plurality of electrothermal transducers. The printing apparatus includes a measurement unit configured to use a corresponding temperature detection element to measure a temperature, which changes due to heat generated by supplying energy, of an electrothermal transducer selected from the plurality of electrothermal transducers, a detection unit configured to detect, based on the temperature measured by the measurement unit, a peak voltage which indicates a point of change, from a state in which the ink is discharged normally from the printhead to a state in which the ink is not discharged from the printhead, and which is based on an output signal from the temperature detection element reflecting temperature change of the electrothermal transducer, a comparison unit configured to compare the peak voltage detected by the detection unit with a threshold value, a change unit configured to change the energy to be supplied to the selected electrothermal transducer, a repetition unit configured to repeat the measurement by the measurement unit, the detection by the detection unit, and the comparison by the comparison unit, by supplying the energy changed by the change unit, until the peak voltage is determined not to be less than the threshold value in the comparison by the comparison unit, and a determination unit configured to determine the energy supplied at a time in which the peak voltage is determined not to be less than the threshold to be minimum discharge energy.

According to another aspect of the present disclosure, there is provided a method of determining minimum discharge energy of a printing apparatus that performs printing by discharging ink onto a print medium from a printhead which includes a plurality of electrothermal transducers, a plurality of temperature detection elements configured to detect temperatures of corresponding electrothermal transducers, and a plurality of orifices arranged in correspondence with the plurality of electrothermal transducers. The method includes using a corresponding temperature detection element to measure a temperature, which changes due to heat generated by supplying energy, of an electrothermal transducer selected from the plurality of electrothermal transducers, detecting, based on the measured temperature, a peak voltage which indicates a point of change, from a state in which the ink is discharged normally from the printhead to a state in which the ink is not discharged from the printhead, and which is based on an output signal from the temperature detection element reflecting temperature change of the electrothermal transducer, comparing the detected peak voltage with a threshold value, changing the energy to be supplied to the selected electrothermal transducer, repeating the measurement, the detection, and the comparison, by supplying the changed energy until the peak voltage is determined not to be less than the threshold value in the comparison, and determining the energy supplied at a time in which the peak voltage is determined not to be less than the threshold to be minimum discharge energy.

The present disclosure is particularly advantageous since the minimum discharge energy of the printhead can be determined while suppressing the influence of external disturbance.

Further features of the present disclosure will become apparent from the following description of exemplary embodiments (with reference to the attached drawings).

DESCRIPTION OF THE EMBODIMENTS

Figure 1:
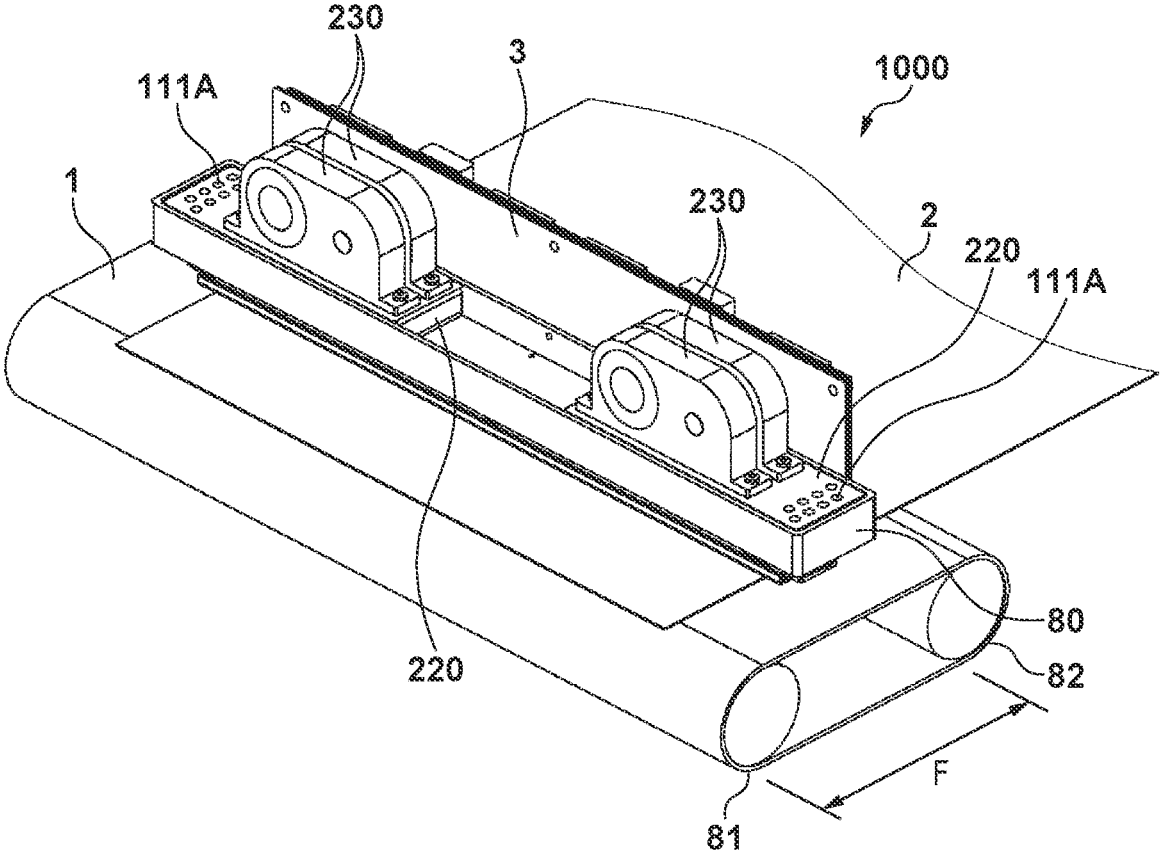
FIG. 1 is a perspective view for explaining the structure of a printing apparatus including a full-line printhead that is an exemplary embodiment of the present disclosure.

Exemplary embodiments of the present disclosure will now be described in detail in accordance with the accompanying drawings.

In this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be broadly interpreted, like the meaning of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "nozzle" (to also be referred to as a "print element") generically means an orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present disclosure, "built-in" means not merely arranging respective elements as separate members on the base surface, but integrally forming and manufacturing respective elements on an element substrate by a semiconductor circuit manufacturing process or the like.

An example of a printing apparatus that uses an inkjet printing method will be described hereinafter. The printing apparatus may be, for example, a single-function printer that only has a print function or a multi-function printer that has a plurality of functions such as the print function, a FAX function, a scanner function, and the like. It may also be a manufacturing apparatus for manufacturing a color filter, an electronic device, an optical device, a microstructure, or the like by a predetermined printing method.

Furthermore, although the printing apparatus described above adopts an arrangement (ink circulation method) in which a liquid such as ink or the like is circulated between a tank and a printhead, another form of arrangement may be adopted. For example, instead of circulating the ink, it is possible to adopt a form in which ink in a pressure chamber is made to flow by arranging two tanks, one on the upstream side and the other on the downstream side, of the printhead and causing the ink to flow from one tank to the other tank.

<Printing Apparatus Incorporating Full-Line Printhead (FIG. 1)>

FIG. 1 is a view showing the schematic arrangement of a printing apparatus 1000 using a full-line printhead to perform printing by discharging ink as an exemplary embodiment of the present disclosure.

As shown in FIG. 1, the printing apparatus 1000 is a line-type printing apparatus that includes a conveyance unit 1 which conveys a print medium 2 and a full-line printhead 3 which is arranged to be approximately perpendicular to the conveyance direction of the print medium 2, and performs continuous printing by continuously or intermittently conveying the plurality of print media 2. Negative pressure control units 230 that control the pressure (negative pressure) in the ink channel, liquid supply units 220 that communicate with the negative pressure control unit 230, and liquid connection units 111A that serve as ink supply and discharge ports to the liquid supply units 220 are arranged in the full-line printhead 3.

As shown in FIG. 1, the liquid connection units 111A arranged at both ends of the printhead 3 are connected to a liquid supply system of the printing apparatus 1000. Accordingly, it is arranged so that four color inks, that is, cyan (C), magenta (M), yellow (Y), and black (K), are supplied from the supply system of the printing apparatus 1000 to the printhead 3, and the inks that have passed through the printhead 3 are collected by the supply system of the printing apparatus 1000. In this manner, the respective color inks can be circulated via channels of the printing apparatus 1000 and channels of the printhead 3.

The negative pressure control units 230, the liquid supply units 220, and the liquid connection units 111A are included in a housing 80.

Note that the print medium 2 is not limited to a cut sheet and may be a continuous rolled sheet.

The full-line printhead (to be referred to as a printhead hereinafter) 3 can perform full color printing by inks of cyan (C), magenta (M), yellow (Y), and black (K). The liquid supply units 220 which are supply channels for supplying the inks to the printhead 3 and main tanks are connected to the printhead 3. In addition, an electric control unit (not shown) that transmits power and a discharge signal to the printhead 3 is also electrically connected to the printhead 3.

In addition, the print medium 2 is conveyed by rotating two conveyance rollers 81 and 82 which are arranged apart from each other by a distance of a length F in the conveyance direction.

The printhead according to this embodiment adopts an inkjet method in which ink is discharged by using thermal energy. Hence, each orifice of the printhead 3 includes an electrothermal transducer (heater). This electrothermal transducer is arranged in correspondence with each orifice, and ink is discharged from a corresponding orifice by supplying electrical energy by applying a pulse voltage to a corresponding electrothermal transducer in response to a print signal.

Note that the printing apparatus is not limited to a printing apparatus using a full-line printhead which has a print width corresponding to the width of the print medium as described above. For example, the printing apparatus can be applied to a so-called serial-type printing apparatus which incorporates, on a carriage, a printhead arranged with orifices in the conveyance direction of a print medium, and performs printing by discharging ink onto the print medium while reciprocally scanning the carriage. As a printhead used for such a serial-type printing apparatus, there is, for example, an arrangement in which an element substrate is incorporated for each of black ink and color inks. However, the present disclosure is not limited to this. It is also possible to form a printhead whose print width is shorter than the print medium width and in which a plurality of element substrates are arranged so as to make the orifice arrays overlap in a nozzle array direction, and cause this printhead to scan the print medium.

Note that the liquid discharged from the printhead is not limited to ink and may be a liquid used to improve the fixability of the ink. Hence, the printhead may be generally referred to as a liquid discharge head.

Furthermore, as the printhead to be used in the printing apparatus, an arrangement that performs full-color printing on a print medium by arranging, in parallel, four single-color printheads 3 corresponding to the respective CMYK inks may also be used. In this case, in contrast to the printhead of the printing apparatus shown in FIG. 1 in which the number of orifice arrays that could be used per one color ink was one, it is possible to provide an arrangement in which a plurality of orifice arrays (for example, twenty arrays) can be used per one color ink. Accordingly, very high-speed printing can be performed by appropriately allotting the print data among the plurality of orifice arrays to perform printing. In addition, even if discharge failure occurs in an orifice, complementary printing can be performed by complementarily discharging ink from an orifice on another array at a position corresponding to the conveyance direction of the print medium of the discharge failure orifice. Since this will improve the printing reliability, it will be suitable for commercial printing and the like.

<Description of Control Arrangement (FIG. 2)>

Figure 2:
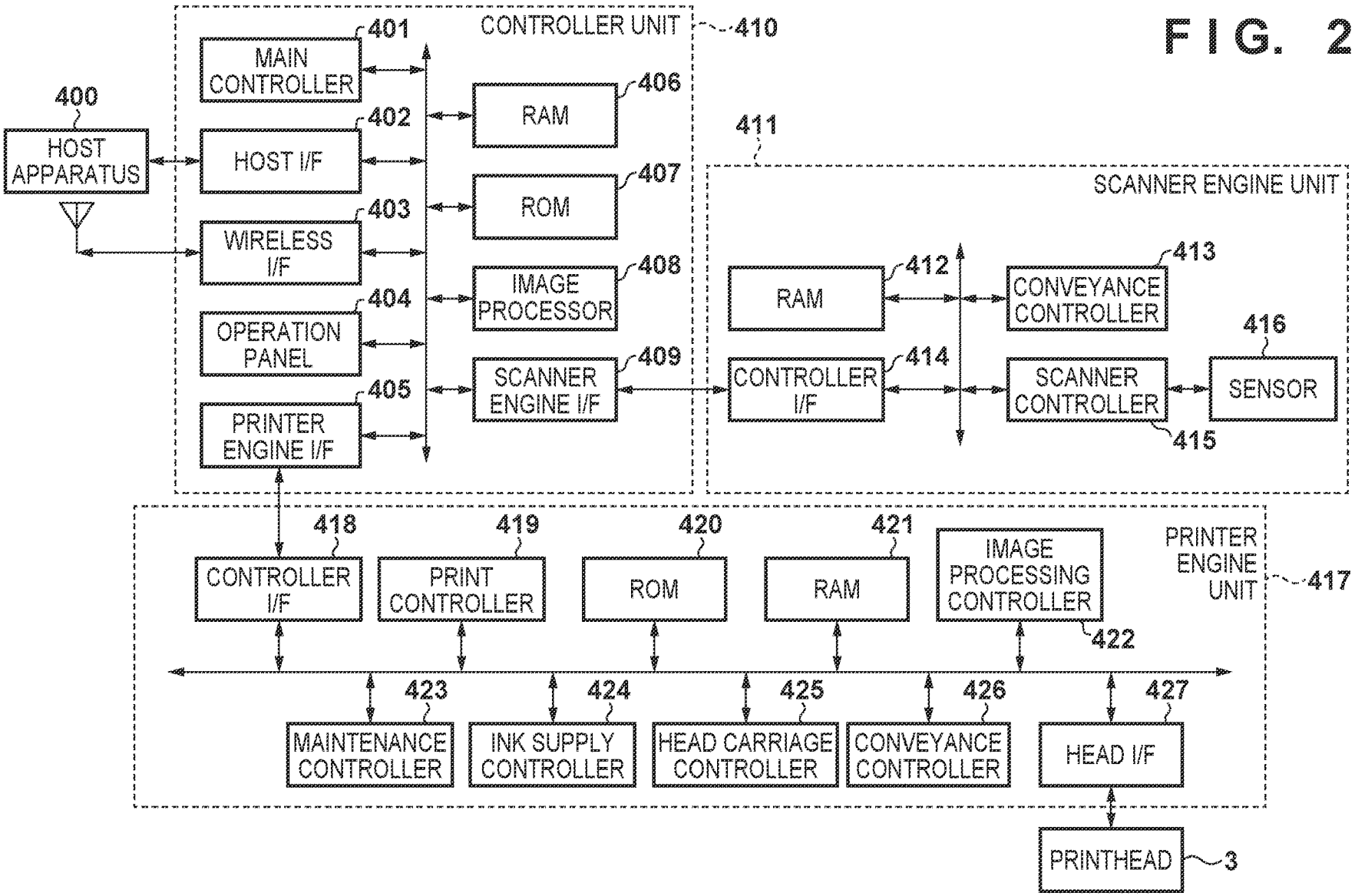
FIG. 2 is a block diagram showing the control arrangement of the printing apparatus shown in FIG. 1.

FIG. 2 is a block diagram showing the arrangement of a control circuit of the printing apparatus 1000.

As shown in FIG. 2, the printing apparatus 1000 is formed from a print engine unit 417 that mainly controls the printing unit, a scanner engine unit 411 that mainly controls the scanner unit, and a controller unit 410 that controls the overall printing apparatus 1000. A print controller 419 incorporating an MPU and a non-volatile memory (an EEPROM or the like) controls the various kinds of mechanisms of the print engine unit 417 in accordance with instructions from a main controller 401 of the controller unit 410. The various kinds of mechanisms of the scanner engine unit 411 are controlled by the main controller 401 of the controller unit 410.

The details of the control arrangement will be described hereinafter.

In the controller unit 410, the main controller 401, which is formed by a CPU, controls the overall printing apparatus 1000 in accordance with programs and various kinds of parameters stored in a ROM 407 by using a RAM 406 as a work area. For example, when a print job is input from a host apparatus 400 via a host I/F 402 or a wireless I/F 403, an image processing unit 408 will perform image processing on the received image data in accordance with the instruction of the main controller 401. The main controller 401 transmits the image data that has undergone the image processing to the print engine unit 417 via a print engine I/F 405.

Note that the printing apparatus 1000 may obtain image data from the host apparatus 400 via wireless communication or wired communication or may obtain image data from an external storage device (a USB memory or the like) connected to the printing apparatus 1000. The communication method to be used in the wireless communication or the wired communication is not particularly limited. For example, Wi-Fi® (Wireless Fidelity) or Bluetooth® is applicable as the communication method used in the wireless communication. Also, for example, a USB (Universal Serial Bus) or the like is applicable as the communication method used in the wired communication. Furthermore, for example, when a read instruction is input from the host apparatus 400, the main controller 401 transmits this instruction to the scanner engine unit 411 via a scanner engine I/F 409.

An operation panel 404 is a unit for a user to make an input operation or an output operation on the printing apparatus 1000. The user can instruct an operation such as copying, scanning, or the like, set a print mode, and recognize the information of the printing apparatus 1000 via the operation panel 404.

In the print engine unit 417, the print controller 419, which is configured by a CPU, controls the various kinds of mechanisms of the print engine unit 417 in accordance with the programs and various kinds of parameters stored in a ROM 420 by using a RAM 421 as a work area.

When various kinds of commands and image data are received via a controller I/F 418, the print controller 419 temporarily stores these commands and image data in the RAM 421. The print controller 419 causes an image processing controller 422 to convert the stored image data into print data so that the printhead 3 can use the data in the print operation. When the print data has been generated, the print controller 419 causes the printhead 3 to execute a print operation based on the print data via a head I/F 427. At this time, the print controller 419 will drive the conveyance rollers 81 and 82 via a conveyance control unit 426 to convey the print medium 2. Print processing is performed under the instruction of the print controller 419 by executing the print operation by the printhead 3 in synchronization with the conveyance operation of the print medium 2.

A head carriage control unit 425 changes the orientation and position of the printhead 3 in accordance with the operation state such as the maintenance state, the print state, or the like of the printing apparatus 1000. An ink supply control unit 424 controls the liquid supply units 220 so that the pressure of ink supplied to the printhead 3 will fall within a suitable range. A maintenance control unit 423 controls the operation of a cap unit and the operation of a wiping unit in a maintenance unit (not shown) when a maintenance operation is performed on the printhead 3.

In the scanner engine unit 411, the main controller 401 controls the hardware resources of the scanner controller 415 by using the RAM 406 as a work area in accordance with the programs and various kinds of parameters stored in the ROM 407. Accordingly, various kinds of mechanisms included in the scanner engine unit 411 are controlled. For example, the main controller 401 will control the hardware resources in a scanner controller 415 via a controller I/F 414 to convey an original, which has been placed on an ADF (not shown) by the user, by a conveyance control unit 413 and read the original by a sensor 416. The scanner controller 415 subsequently stores the read image data in a RAM 412.

Note that the print controller 419 can convert image data obtained in the manner described above into print data to cause the printhead 3 to execute a print operation based on the image data read by the scanner controller 415.

<Description of Ink Circulation Channel (FIG. 3)>

Figure 3:
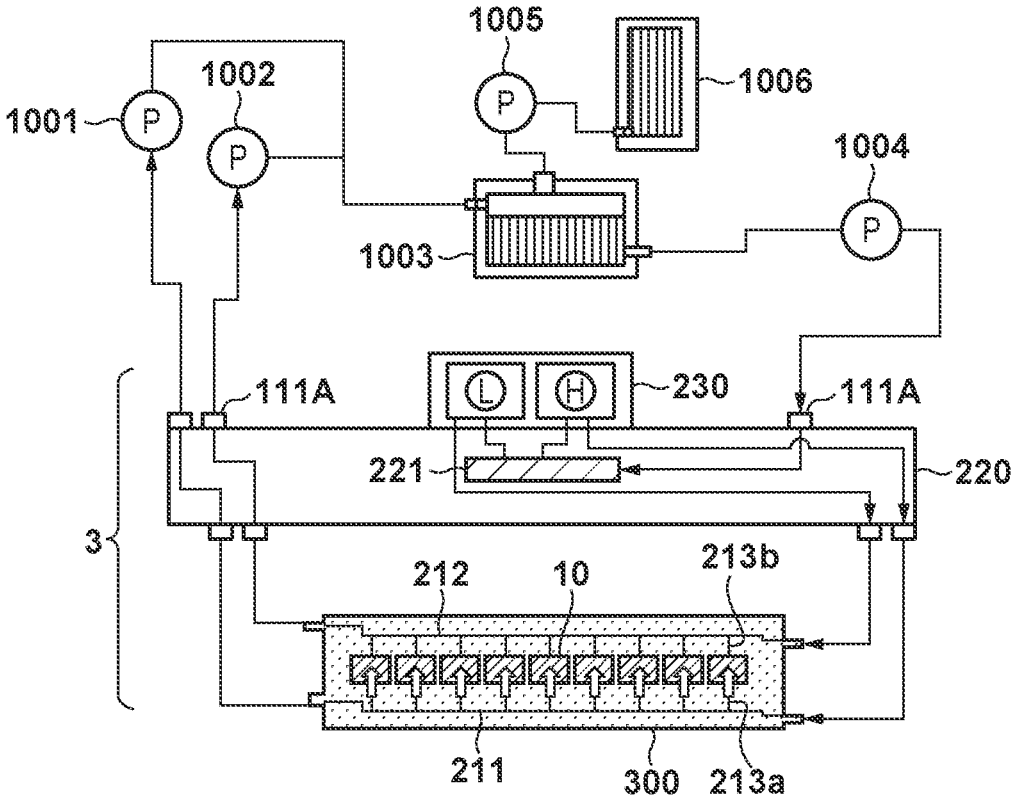
FIG. 3 is a schematic view showing the ink circulation arrangement between the printhead and an ink tank.

FIG. 3 is a schematic view showing the circulation arrangement of ink between the printhead and the ink tank.

As shown in FIG. 3, the printhead 3 is fluidly connected to a pump (high pressure side) 1001, a pump (low pressure side) 1002, and a buffer tank 1003 via channels.

Note that although only the channels in which one color ink circulates are shown in FIG. 3 for the sake of descriptive convenience, circulation channels corresponding to four color inks of cyan (C), magenta (M), yellow (Y), and black (K) will be arranged in the printhead 3 and the main body of the printing apparatus in practice.

The buffer tank 1003, which serves as a sub-tank and is connected to a main tank 1006, includes an atmosphere communication port (not shown) for causing the inside of the tank to communicate with the outside and can discharge bubbles in the ink to the outside. The buffer tank 1003 is connected to the main tank 1006 via a pump 1005. When ink has been consumed in the printhead 3, the pump 1005 transfers an amount of ink corresponding to the amount of the consumed ink from the main tank 1006 to the buffer tank 1003. The ink is consumed when ink is discharged from the orifices of the printhead 3 at the time of, for example, an actual image print operation, a suction recovery operation, or the like.

The two pumps 1001 and 1002 have the role of drawing out ink from the liquid connection units 111A of the printhead 3 and making the ink flow to the buffer tank 1003. It is preferable to use a positive displacement pump that has a quantitative liquid transmission capability as the pump 1001. Although, more specifically, a tube pump, a gear pump, a diaphragm pump, a syringe pump, or the like may be used, it is also possible to use, for example, a configuration in which a general constant flow valve or a relief valve is arranged at the pump port to ensure a predetermined flow rate. When the printhead 3 is driven, the pump (high pressure side) 1001 and the pump (low pressure side) 1002 will make the predetermined amount of ink present in a common supply channel 211 and a common collection channel 212, respectively, flow. It is preferable to set this flow rate to be equal to or more than a rate in which the temperature difference between element substrates 10 of the printhead 3 will not influence the printing image quality. However, if the flow rate is set too high, the negative pressure difference between the element substrates 10 becomes too large due to the influence from the channel pressure loss in a liquid discharge unit 300 and creates density unevenness on the image. Hence, it is preferable to set the flow rate in consideration of the temperature difference and the negative pressure difference between the element substrates 10.

A negative pressure control unit 230 is arranged between the channels of a pump 1004 and the liquid discharge unit 300. Hence, the negative pressure control unit 230 has a function to perform an operation so that a preset predetermined pressure will be maintained as the pressure closer to the downstream side (that is, on the side of the liquid discharge unit 300) than the side of the negative pressure control units 230 even in a case in which the flow rate of the circulated ink changes due to a print operation duty difference. Any kind of mechanism can be used as each of the two pressure adjustment mechanisms forming the negative pressure control unit 230 as long as it is a mechanism that can control the changes of a pressure closer to the downstream side than the negative pressure control unit 230 to fall within a predetermined range or less with respect to a desired setting pressure.

For example, a mechanism like a so-called "decompression regulator" can be adopted. In a case in which the decompression regulator is used, it is preferable to increase the pressure on the upstream side of the negative pressure control unit 230 via the liquid supply unit 220 by the pump 1004 as shown in FIG. 3. Setting this kind of arrangement can suppress the influence of the head pressure of the buffer tank 1003 on the printhead 3, thus increasing the degree of freedom of the layout of the buffer tank 1003 in the printing apparatus 1000. It is sufficient to use, as the pump 1004, a pump which has a head pressure equal to or more than a predetermined pressure in the range of the ink circulation flow rate used when the printhead 3 is driven, and for example, a turbo pump or a positive displacement pump may be used. More specifically, a diaphragm pump or the like is applicable as the pump 1004. In addition, instead of the pump 1004, for example, a head tank arranged to have a predetermined head difference with respect to the negative pressure control unit 230 may be applicable.

As shown in FIG. 3, each negative pressure control unit 230 includes two pressure adjustment mechanisms that have been set with different control pressures from each other. Of the two pressure adjustment mechanisms, an adjustment mechanism (to be denoted with a reference symbol "H" in FIG. 3) of the relatively high pressure setting side and an adjustment mechanism (to be denoted with a reference symbol "L" in FIG. 3) of the relatively low pressure setting side are connected to the common supply channel 211 and the common collection channel 212, respectively, in the liquid discharge unit 300 via the liquid supply unit 220. The common supply channel 211, the common collection channel 212, and individual supply channels 213*a* and individual collection channels 213*b* which communicate with the respective element substrates 10 are arranged in the liquid discharge unit 300. Since the individual supply channels 213*a* and the individual collection channels 213*b* communicate with the common supply channel 211 and the common collection channel 212, respectively, a part of the ink will flow (see arrows in FIG. 3) from the common supply channel 211 to the common collection channel 212 through the internal channels of the respective element substrates 10. This is due to the fact that a pressure difference has been generated between the two common collection channels because a pressure adjustment mechanism H is connected to the common supply channel 211 and a pressure adjustment mechanism L is connected to the common collection channel 212.

In this manner, a flow in which a part of the ink passes through each element substrate 10 while making the ink flow so as to pass through each of the common supply channel 211 and the common collection channel 212 is generated in the liquid discharge unit 300. Hence, the heat generated in each element substrate 10 can be discharged outside the element substrate 10 by the flow of ink flowing through the common supply channel 211 and the common collection channel 212. In addition, since this kind of arrangement can also cause ink to flow to a pressure chamber and orifices that are not performing a print operation when the printhead 3 is performing printing, it can suppress ink viscosity from increasing in these parts. Furthermore, the ink that has become more viscous or a foreign substance in the ink can be discharged to the common collection channel 212.

The printhead 3 achieves high speed and high image quality printing by such an arrangement.

<Description of Arrangement of Printhead (FIG. 4)>

Figure 4:
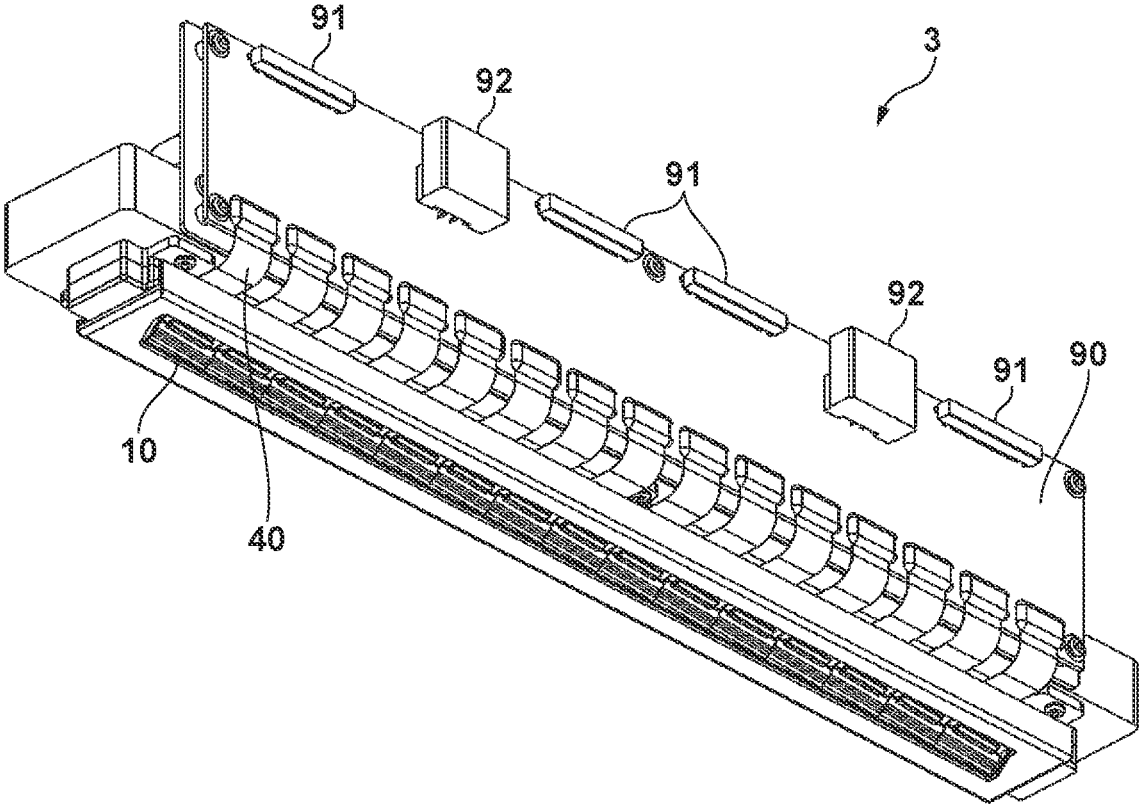
FIG. 4 is a perspective view showing the schematic arrangement of a printhead 3.

FIG. 4 is a perspective view showing the schematic arrangement of the printhead 3. The printhead 3 is a line-type printhead on which fifteen arrays of element substrates 10 each capable of discharging four color inks of C/M/Y/K are arranged linearly (arranged in a line). Note that other than this kind of an arrangement, it may be set so that four printheads 3, each of which is formed to discharge one color of ink, will be arranged in the conveyance direction of the print medium to discharge the four colors of ink (C/M/Y/K).

As shown in FIG. 4, the printhead 3 includes signal input terminals 91 and power supply terminals 92 which are electrically connected to the element substrates 10 via flexible wiring substrates 40 and a flexible wiring substrate 90. The signal input terminals 91 and the power supply terminals 92 are electrically connected to the control unit of the printing apparatus 1000 and supply a discharge driving signal and power required for discharging, respectively, to the element substrates 10. The number of the signal input terminals 91 and the number of power supply terminals 92 can be made smaller than the number of the element substrates 10 by integrating the wiring by the electrical circuit in the flexible wiring substrate 90. Accordingly, the number of electrical connectors that need to be removed when the printhead 3 is to be attached to the printing apparatus 1000 or when replacing the printhead can be reduced.

<Description of Structure of Element Substrate (FIGS. 5 and 6)>

The arrangement of each element substrate 10 will be described here.

Figure 5:
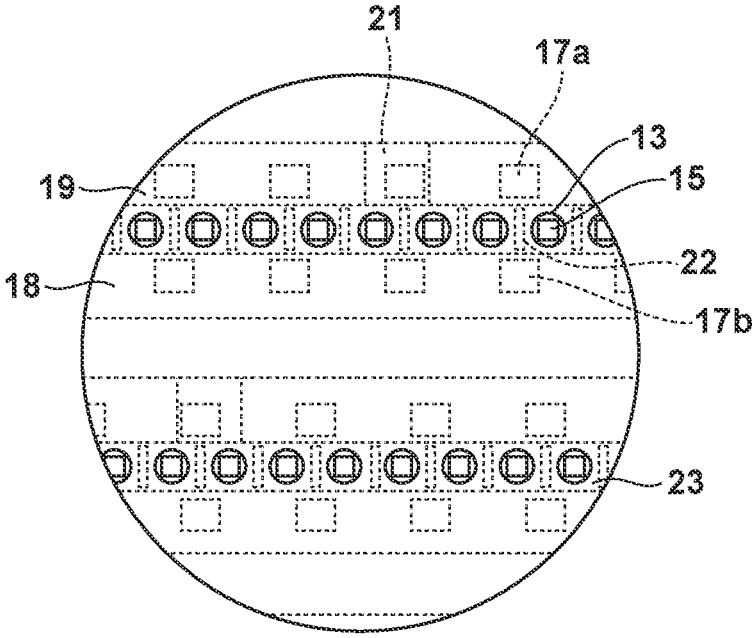
FIG. 5 is an enlarged plan view of a surface on which orifices of an element substrate are formed.

FIG. 5 is an enlarged plan view of the surface on which the orifices of the element substrate are formed.

Figure 6:
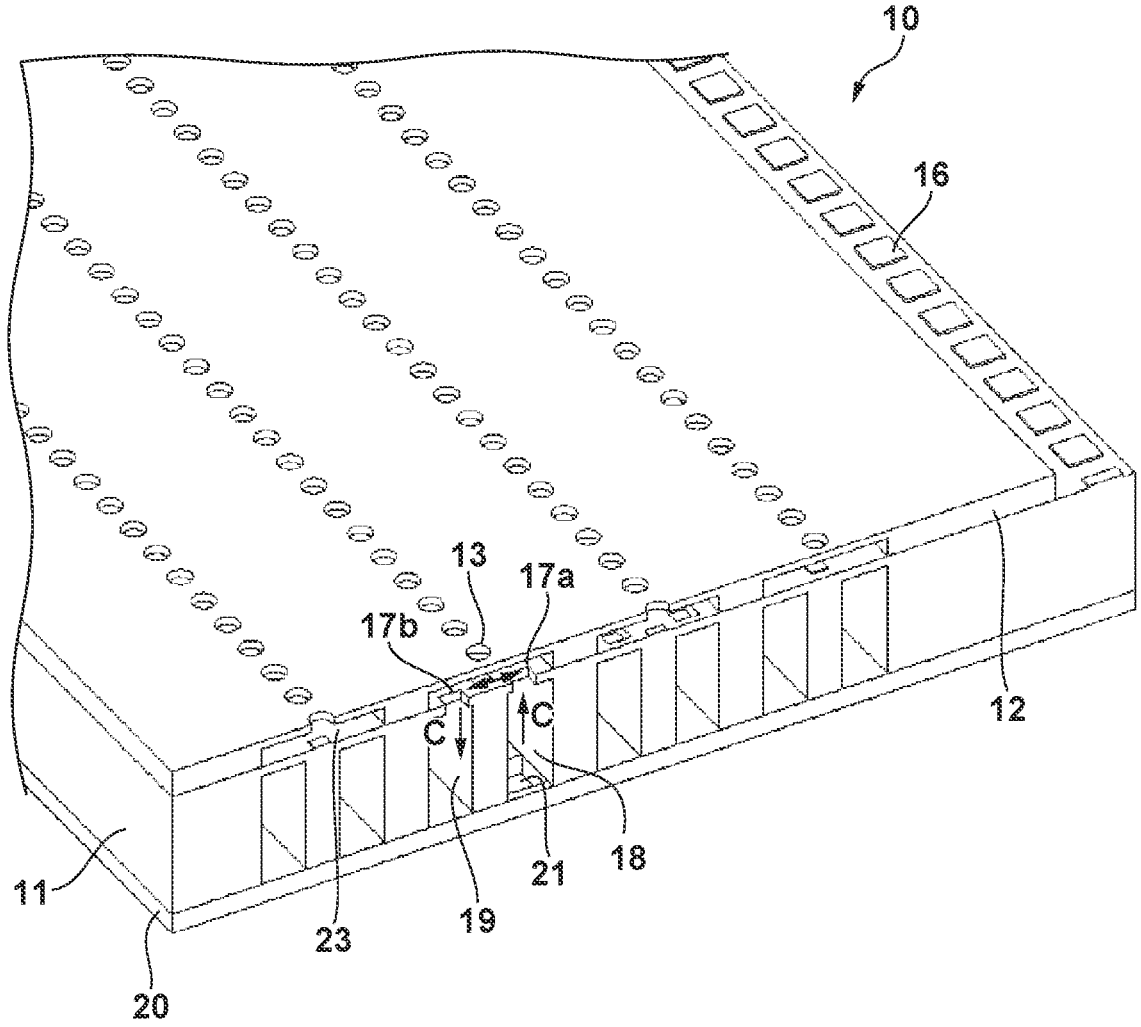
FIG. 6 is a perspective view showing a section of an element substrate 10 and a lid member shown in FIG. 5.

FIG. 6 is a perspective view showing a section of a lid member and the element substrate 10 shown in FIG. 5.

As shown in FIG. 5, a print element 15 which is a heat generating element to cause ink to bubble by thermal energy is arranged in each position corresponding to each orifice 13, and a pressure chamber 23 which includes the print element 15 has been partitioned by barriers 22. Each print element 15 is electrically connected to a terminal arranged at the end of the element substrate 10 by an electrical wiring line (not shown) arranged in the element substrate 10. The print element 15 generates heat based on a pulse signal input from the control circuit of the printing apparatus 1000 via the flexible wiring substrate 90 and the corresponding flexible wiring substrate 40 to boil the ink. The bubbling force generated by the boiling causes ink to be discharged from the orifice 13.

As shown in FIG. 5, a liquid supply channel 18 extends on one side of each orifice array and a liquid collection channel 19 extends on the other side of the orifice array. The liquid supply channel 18 and the liquid collection channel 19 are channels that extend in the orifice array direction and are arranged in the element substrate 10. The liquid supply channel 18 and the liquid collection channel 19 communicate with each orifice 13 of a corresponding array via a collection channel 17*b* and a supply channel 17*a*, respectively.

As shown in FIG. 6, a sheet-like lid member 20 has been stacked on the back surface of the surface on which the orifices 13 have been formed on the element substrate 10, and a plurality of openings 21 communicating with the liquid supply channel 18 and the liquid collection channel 19 are arranged on the lid member 20. In this embodiment, three openings 21 are arranged with respect to each liquid supply channel 18 and two openings 21 are arranged with respect to each liquid collection channel 19 on the lid member 20.

As shown in FIG. 5, each of the openings 21 of the lid member 20 communicates with a plurality of communication ports (not shown). As shown in FIG. 6, the lid member 20 also functions as a lid that forms a part of the walls of the liquid supply channels 18 and liquid collection channels 19 to be formed in a base 11 of the element substrate 10. The lid member 20 is preferably made of a material that has a sufficient corrosion resistance to ink, and the position and the shape of each opening 21 need to be highly accurate from the point of view of preventing the mixing of colors. Hence, it is preferable to use a photosensitive resin material or a silicon plate as the material of the lid member 20, and to arrange the openings 21 by a photolithography process. In this manner, the lid member is a member that changes the pitch of the channels by the openings 21, and it is preferable for the lid member to have a small thickness in consideration of pressure loss and to be formed of a film-like member.

The flow of ink in the element substrate 10 will be described next.

The base 11 made of Si and an orifice forming member 12 made of photosensitive resin are stacked on the element substrate 10, and the lid member 20 is joined to the back surface of the base 11. The print elements 15 are formed on one side of the surface of the base 11 (FIG. 5), and trenches forming the liquid collection channels 19 and the liquid supply channels 18 extending along the corresponding orifice arrays are formed on the side of the back of the surface. Each of the liquid supply channels 18 and the liquid collection channels 19 formed by the base 11 and the lid member 20 is connected to the common supply channel 211 and the common collection channel 212 in the channel member, and a pressure difference is created between the liquid supply channels 18 and the liquid collection channels 19.

When printing is performed by discharging ink from the plurality of orifices 13 in the printhead 3, the pressure difference will cause the flow of ink in each liquid supply channel 18 arranged in the base 11 to move in the manner indicated by arrows C in FIG. 6 for each orifice not performing the discharge operation. That is, the ink will flow to each liquid collection channel 19 via the supply channel 17*a*, each pressure chamber 23, and the collection channel 17*b*. Ink with increased viscosity generated due to evaporation from the orifices 13, bubbles, foreign substances, and the like in each pressure chamber 23 and each orifice 13 not performing the discharge operation can be collected to each liquid collection channel 19 by this flow. In addition, this flow can suppress the increase in the viscosity of ink in each orifice 13 and each pressure chamber 23.

The ink collected to each liquid collection channel 19 is collected sequentially through the openings 21 of the lid member 20 and the liquid communication ports of a support member by the communication ports in the channel members, the individual collection channels 213*b*, and the common collection channel 212. This ink is finally collected to the supply channel of the printing apparatus 1000.

That is, the ink supplied from the printing apparatus main body to the printhead 3 is supplied and collected by flowing in the following order. The ink first flows from the liquid connection units 111A of each liquid supply unit 220 into the printhead 3. Subsequently, the ink is supplied to each pressure chamber 23 by sequentially flowing through the liquid communication ports arranged in the support member, the openings 21 arranged in the lid member 20, and each liquid supply channel 18 and the corresponding supply channel 17*a* arranged in the base 11. Of the ink supplied to each pressure chamber 23, ink that is not discharged from the orifice 13 will flow sequentially through the corresponding collection channel 17*b* provided in the base 11, the corresponding liquid collection channel 19, the corresponding opening 21 arranged on the lid member 20, and the corresponding liquid communication port arranged in the support member.

Furthermore, the ink will flow from each liquid connection unit 111A arranged in the liquid supply unit 220 to the outside of the printhead 3.

In the ink circulation channel configuration shown in FIG. 3, the ink that flows from each liquid connection units 111A is supplied to a joint rubber (not shown) with the printhead 3 via the negative pressure control unit 230.

In addition, as shown in FIG. 3, the ink that flowed in from one end of the common supply channel 211 of the liquid discharge unit 300 will not be supplied entirely to the pressure chambers 23 via the respective individual supply channels 213*a*. There can be ink that will flow from the other end of the common supply channel 211 to the liquid supply unit 220 without flowing into the individual supply channels 213*a*. In this manner, by providing a channel that allows ink to bypass the element substrate 10, the backflow of the ink circulation flow can be suppressed even in a case in which the element substrate 10 including very fine channels with high flow resistance is included as in this embodiment. Thus, since the increase in the ink viscosity in pressure chambers and portions in the vicinity of orifices can be suppressed in the printhead 3, shifts from a normal discharge direction and a non-discharge state can be suppressed, and high image quality printing can be performed.

Note that although a parallelogram has been used as the shape of the principal plane of the element substrate in this case, the present disclosure is not limited to this, and an element substrate which has another shape, for example, a rectangle, a trapezoid, or the like may be used.

<Relationship Between Print Element and Temperature Detection Element on Element Substrate (FIGS. 7A and 7B)>

Figure 7A:
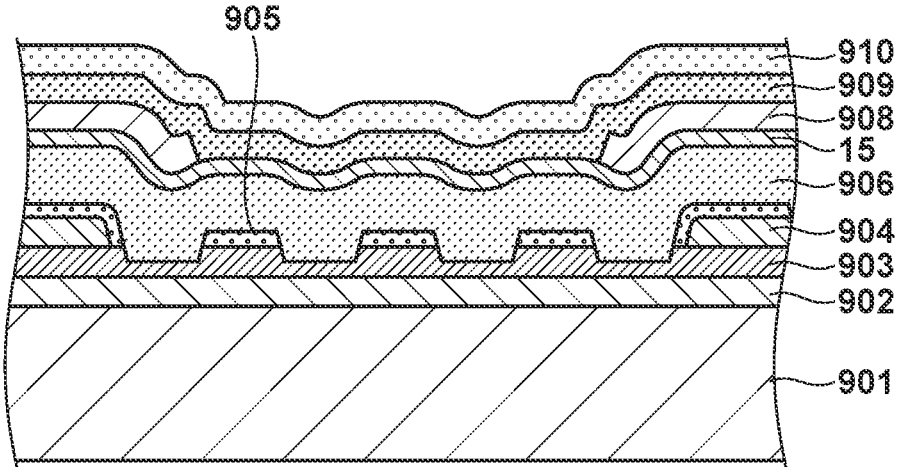
FIGS. 7A and 7B are views showing the relationship between a print element and a temperature detection element.
Figure 7B:
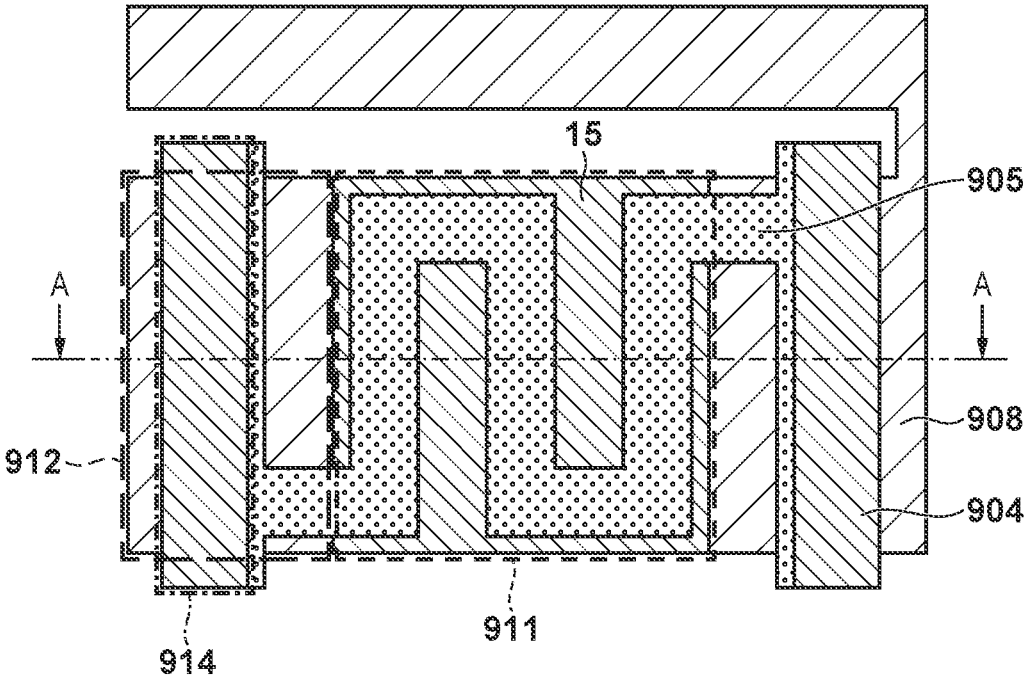

FIGS. 7A and 7B are views showing the relationship between the print element and the temperature detection element. FIG. 7A is a sectional view of the element substrate showing the positional relationship between the print element (heater) 15 and a temperature detection element 905 formed on the element substrate 10. FIG. 7B is a plan view showing the positional relationship between the print element 15 and the temperature detection element 905. Note that FIG. 7A is a sectional view taken along a line A-A shown in FIG. 7B, and FIG. 7B is a perspective view showing the positional relationship of the temperature detection element 905 when seen from the side of a Si base 901, and illustrations of the nozzle portion of the orifice 13 or the like and some of films have been omitted for the sake of descriptive convenience.

As shown in FIG. 7A, a plurality of layers are formed on the Si base 901 in the element substrate 10. More specifically, an insulation film PSG 903 is formed via a field oxide film 902 made of $SiO_2$ or the like on the Si base 901. The temperature detection element 905 formed by a thin film resistor made of Al, Pt, Ti, Ta, or the like and an AL1 wiring 904 for connecting and wiring the temperature detection element 905 are arranged on the insulation film PSG 903.

In addition, an interlayer insulation film 906 made of SiO or the like is arranged on a layer further above the aforementioned layer, and the heater 15 which is capable of converting electric energy to thermal energy and is made of TaSiN or the like and an AL2 wiring 908 that connects the heater 15 to a drive circuit formed on the Si base 901 are arranged on the interlayer insulation film 906. In addition, a passivation film 909 made of $SiO_2$ and an anti-cavitation film 910 which is made of Ta, Ir, or the like and increases the anti-cavitation feature of the heater 15 are also arranged.

As shown in FIG. 7B, on the plane of the element substrate 10, there are a region 911 of the heater 15, a region indicating an AL2 wiring 912 connecting the heater 15 to the drive circuit, and an AL1 wiring 914 which is the individual wiring of the temperature detection element 905.

This kind of arrangement of the element substrate 10 is formed by a semiconductor manufacturing process. Since the element substrate 10 according to this embodiment can be manufactured by placing the temperature detection element 905 on the AL1 layer, performing film forming, and executing patterning, it can be manufactured without changing the structure of a conventional element substrate.

Note that although the temperature detection element 905 is shown to have a meander shape in FIG. 7B, the present disclosure is not limited to this. The temperature detection element may be formed to have, for example, a rectangular shape. A case in which the temperature detection element 905 has a meander shape as that shown in FIG. 7B is advantageous in that the temperature change can be detected accurately because the detection signal increases as the resistance value of the temperature detection element 905 increases.

An embodiment of a method of determining the discharge condition (minimum discharge energy) of a printhead to be incorporated in a printing apparatus having the arrangement described above will be described next.

First Embodiment

Figure 8A:
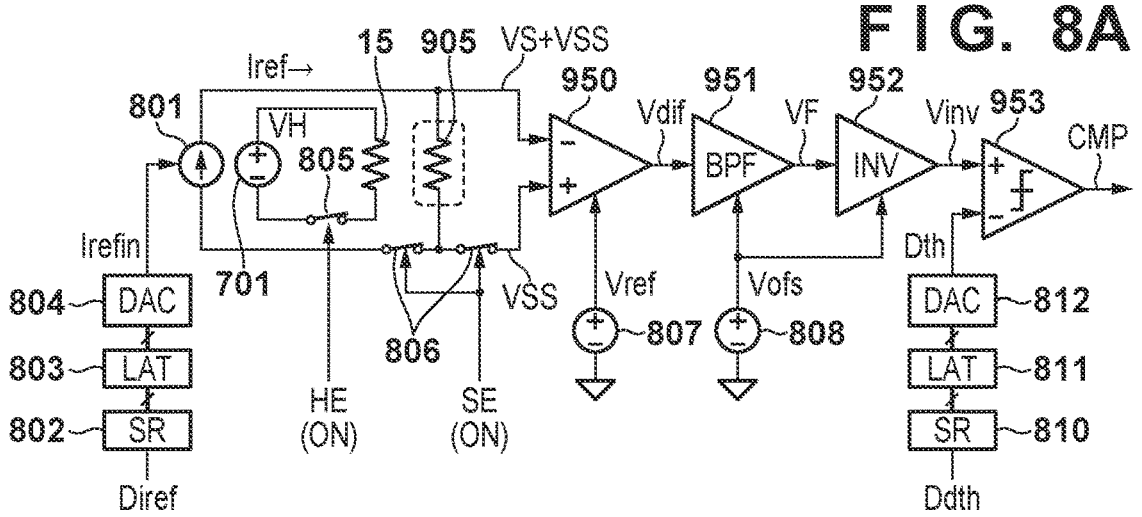
FIGS. 8A, 8B, 8C, and 8D are views showing the arrangement of a circuit for detecting the temperature of a heater and temperature profiles which have been detected.
Figure 8B:
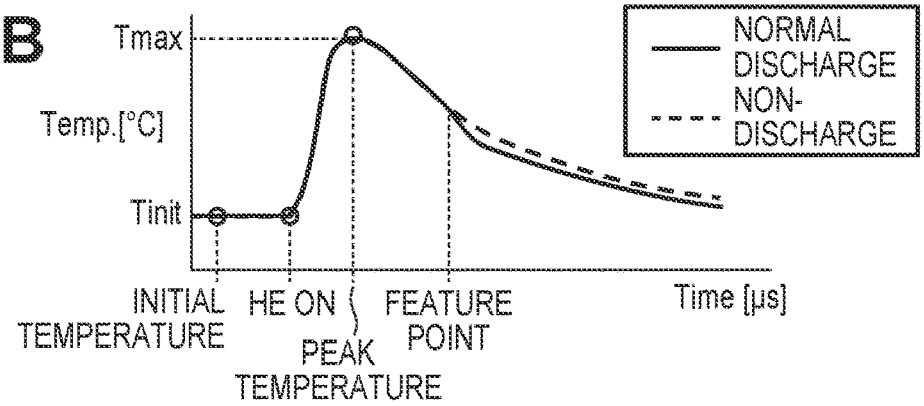

FIGS. 8A to 8D are views showing the arrangement of a circuit for detecting the temperature of a heater and the detected temperature profiles. FIG. 8A is a view showing the arrangement of a temperature detection circuit that is to be mounted in the printhead, and FIG. 8B is a view showing the temperature profile detected by a temperature detection element 905 at the time of normal ink discharge and the temperature profile obtained at the time of ink discharge failure when a drive voltage has been applied to a heater 15.

As shown in FIG. 8A, the heater 15 is driven by a constant voltage source 701 included in the main body unit of a printing apparatus 1000, and a constant voltage VH is applied to the heater 15 when a heater driving signal HE is set to ON (high active) and a switch element 805 is closed. Also, the application of constant voltage VH to the heater 15 is cut off when the heater driving signal HE is set to OFF (low) and the switch element 805 is opened. In this manner, the constant voltage VH is applied as a rectangular pulse to the heater 15 by setting the heater driving signal HE to ON/OFF.

On the other hand, the temperature detection element 905 is a thin film resistor. A constant current source Iref is supplied to the temperature detection element 905 when a current is supplied from a constant current source 801, a sensor selection signal SE is set to ON (High active), and the switch elements 806 are closed. Simultaneously with this operation, voltage signals from both ends of the temperature detection element 905 are input to a differential amplifier 950. In addition, when the sensor selection signal SE is set to OFF (Low), the switch element 806 are opened, the constant current Iref supplied to the temperature detection element 905 is cut off, and the voltage signals from both ends of the temperature detection element 905 supplied to the differential amplifier 950 are also cut off.

As is obvious from the arrangement described above, a heater among the plurality of heaters 15 included in a printhead 3 and a temperature detection element corresponding to this heater are selected by the heater driving signal HE and the sensor selection signal SE supplied from the main body unit of the printing apparatus, and the temperature of the heater is detected.

The constant current Iref is settable in, for example, 32 steps from 0.6 mA to 3.7 mA at a pitch of 0.1 mA. The setting width of one step will be referred to one level as hereinafter.

In a range of 32 levels, a setting value Diref of the constant current source Iref which is input from the main body of the printing apparatus 1000 is set as a 5-bit digital value and transferred to a shift register (SR) 802 in synchronization with a clock signal (not shown). Subsequently, the setting value Diref is latched by a latch circuit (LAT) 803 at a timing according to a latch signal (not shown) and is output to a current outputting type digital-to-analog converter (DAC) 804.

The output signal of the latch circuit 803 is held until the next latch timing, and the next setting value Diref is transferred to the shift register (SR) 802 during this period. An output current Irefin of the digital-to-analog converter (DAC) 804 is input to the constant current source 801, amplified by a factor of 12, and output as the constant current Iref.

By letting T0 be the normal temperature, Rs0 be the resistance at the normal temperature, and TCR as a temperature resistance coefficient of the temperature detection element 905, a resistance Rs of a temperature T of the temperature detection element 905 is expressed as $$Rs=Rs0\{1+TCR(T-T0)\} \quad (1)$$

When the constant current Iref is applied to the temperature detection element 905, a differential voltage VS between both ends is expressed as $$VS=Iref\cdot Rs=Iref\cdot Rs0\{1+TCR(T-T0)\} \quad (2)$$

Although the differential voltage VS is inverted and input to the differential amplifier 950, if the differential voltage is maintained intact, an output Vdif will be a negative voltage equal to or less than a ground potential GND and will be set as Vdif=0 V to be fed back to a negative (−) terminal of the operation amplifier in the differential amplifier 950 in practice. Hence, an unpredicted signal will be ultimately output. In order to avoid such a state, an offset voltage Vref sufficient enough to set the output Vdif to be equal to or more than the ground potential GND will be applied to the differential amplifier 950 by a constant voltage source 807.

Figure 8C:
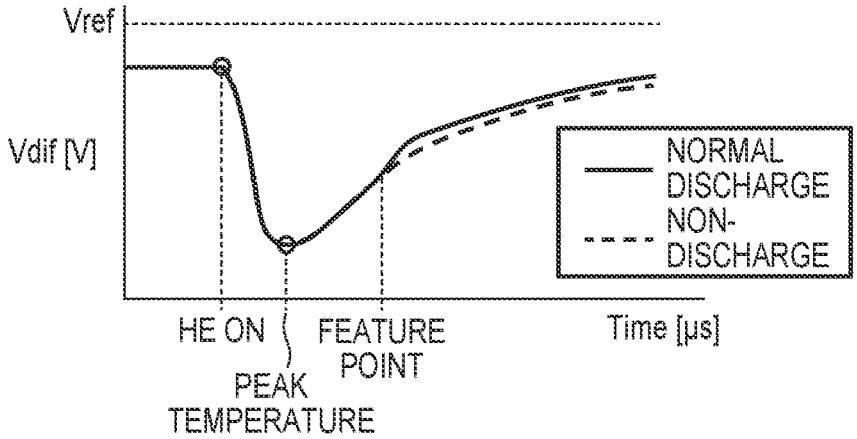

FIG. 8C shows the profiles of the output Vdif at the time of normal ink discharge and at the time of ink discharge failure when the temperature profiles of the heater 15 detected by the temperature detection element 905 are as that shown in FIG. 8B. As shown in FIG. 8C, since the output waveform has been inverted upside down from the temperature waveform, a negative inclination represents a temperature rise process and a positive inclination represents a temperature drop process.

As shown in FIGS. 8B and 8C, at the time of normal ink discharge, some of the discharged ink droplets can fall onto the heater 15 due to the contraction of bubbles after the bubbling, and this can cause the appearance of a feature point at which the temperature of the heater 15 rapidly drops. In contrast, since ink droplets do not fall onto the heater at the time of ink discharge failure, the temperature will change moderately and no feature point will appear.

Next, the output Vdif of the differential amplifier 950 is input to a filter circuit (BPF) 951. The filter circuit (BPF) 951 is a circuit for converting the maximum gradient at the time of the temperature drop representing the discharge state of the output Vdif into a peak, and is formed by band-pass filter (BPF) obtained by cascade-connecting a second order low-pass filter and a first order high-pass filter. The low-pass filter can attenuate high frequency noise on the higher frequency side than a cutoff frequency fcL, and the high-pass filter can remove a direct current component by first-order-differentiating a signal on the lower frequency side than a cutoff frequency fcH to extract the gradient at the time of the temperature drop. By performing such signal processing by the filter circuit 951, the filter circuit 951 will output a signal VF which will serve as the basis for determining the normal ink discharge state or the ink discharge failure state.

Note that since the signal VF may also become a negative voltage equal to or less than the ground potential GND in this case, a constant voltage source 808 will apply, to the positive (+) terminal of the filter circuit (BPF) 951, an offset voltage Vofs sufficient enough to make the signal VF equal to or more than the ground potential GND in the manner described above.

The output signal VF of the filter circuit (BPF) 951 is amplified by an inverting amplifier (INV) 952 of a subsequent stage because the output voltage has decreased due to the attenuation of the low frequency signal by the high-pass filter.

Since the positive voltage of the input signal VF is inverted into a negative voltage in the inverting amplifier (INV) 952, the signal voltage is increased by applying the offset voltage Vofs in a manner like the high-pass filter. More specifically, the output from the constant voltage source 808 which applies the offset voltage Vofs to the high-pass filter is branched, and the same offset voltage Vofs is applied also to the inverting amplifier (INV) 952.

Accordingly, letting Ginv be a gain of an inverting amplifier (INV) 953, an output signal Vinv of the inverting amplifier (INV) 952 is expressed as $$Vinv=Vofs+Ginv(Vofs-VF) \quad (3)$$

Figure 8D:
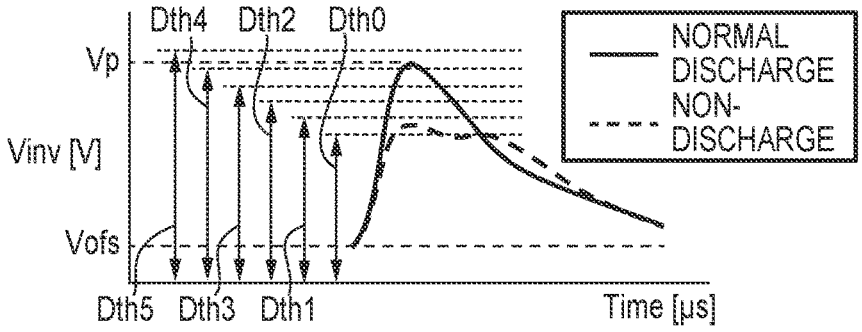

FIG. 8D shows the profile of the output signal Vinv at the time of normal ink discharge and that at the time of ink discharge failure. According to FIG. 8D, a peak Vp due to the maximum temperature drop rate after the feature point will appear at the time of normal ink discharge, and the peak that appears in the waveform at the time of ink discharge failure will be smaller than the waveform at the time of normal ink discharge since the feature point will not appear and the temperature drop rate will be low at the time of ink discharge failure.

The output signal Vinv of the inverting amplifier (INV) 952 is input to the positive (+) terminal of the inverting amplifier (INV) 953, compared to a threshold voltage Dth input to the negative (−) terminal, and an effective determination pulse signal CMP is output if it is determined that Vinv>Dth.

The threshold voltage Dth is settable by, for example, 256 levels from 0.5 V to 2.54 Vat a pitch of 8 mV. If it is in the range of the 256 levels, a setting value Ddth of the threshold voltage Dth is set as an 8-bit digital value and is transferred to a shift register (SR) 810 in synchronization with the clock signal (not shown). Subsequently, the setting value Ddth is latched by a latch circuit (LAT) 811 at a timing according to a latch signal (not shown) and is output to a voltage outputting type digital-to-analog converter (DAC) 812. The output signal of the latch circuit 811 is held during a period until the next latch timing, and the next setting value Ddth is transferred to the shift register 810 during this period.

The detection of the peak voltage Vp of the output signal Vinv is executed by using the inverting amplifier (INV) 953 in accordance with the procedure to be described next.

First, in the first latch period, a drive pulse is applied to the heater 15 in a state in which a constant current source Iref0 (for example, 1.6 mA) corresponding to a reference setting value Diref0 is applied to the temperature detection element 905. At this time, a reference setting value Ddth0 corresponding to a threshold voltage Dth0 as a reference will be input to the inverting amplifier (INV) 953 and compared with a peak value of the output signal Vinv. If the determination pulse signal CMP is output from the inverting amplifier (INV) 953, the level of the threshold voltage Dth is increased by one step and compared with the peak value of the output signal Vinv in like manner in the next latch period.

This kind of processing is repeated until the determination pulse signal CMP is not output, and the threshold voltage Dth of the final level at which the determination pulse signal CMP is output is set as the peak voltage Vp. Hence, the peak voltage Vp is information that reflects the point of change from a state in which the ink is normally discharged to a state in which the ink is not discharged. In the example of FIG. 8D, since the output of the determination pulse signal CMP stops at a threshold voltage Dth5 as the threshold voltage is sequentially increased from the threshold voltage Dth0 to Dth1, Dth2, . . . when performing peak voltage detection at the time of a normal ink discharge state, a threshold voltage Dth4 at which the final CMP output was obtained is set as the peak voltage Vp.

On the other hand, if the determination pulse signal CMP is not output in the first latch period, the level of the threshold voltage Dth is decreased by one step and compared with the peak value of the output signal Vinv in like manner in the next latch period. This kind of processing is repeated until the determination pulse signal CMP is output, and the threshold voltage Dth of the level at which the determination pulse signal CMP is output is set as the peak voltage Vp. In the example of the normal ink discharge operation shown in FIG. 8D, the threshold voltage Dth4 is set as the peak voltage Vp because the determination pulse signal CMP starts to be output from Dth4 after decreasing the threshold voltage from Dth5 to Dth4.

In this embodiment, a method of determining whether the ink discharge operation is a normal discharge or a discharge failure is used as described above to measure minimum dischargeable energy Eth. In a case in which energy that has not reached the minimum dischargeable energy has been applied, the bubbling by the heater 15 will be insufficient and the ink droplet will not be discharged (discharge failure). The ink droplet will be discharged by the bubbling force when the energy has reached the minimum dischargeable energy. That is, the peak voltage Vp of the output signal Vinv will be sequentially measured while changing the discharge energy, and the minimum dischargeable energy Eth will be obtained from the changes of the peak voltage Vp.

Figure 9A:
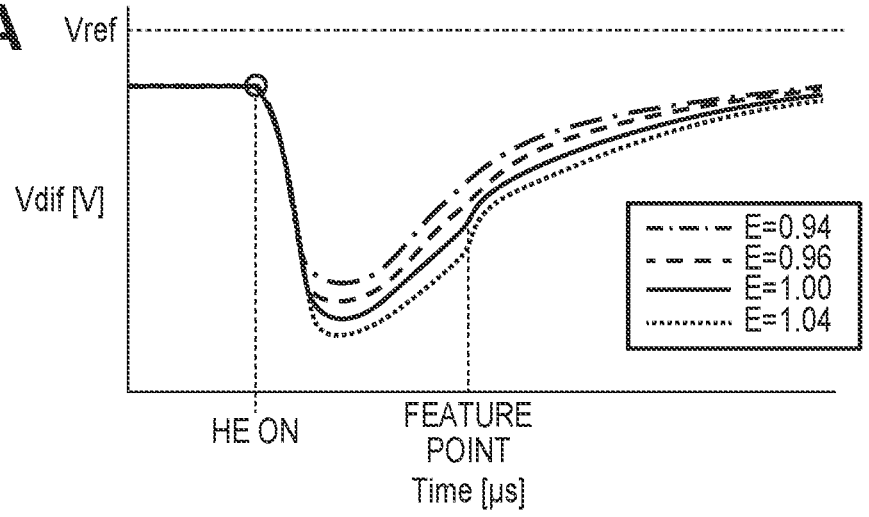
FIGS. 9A, 9B, and 9C are graphs showing the profiles of a differential amplifier output Vdif and a peak voltage Vp of an output voltage when discharge energy is changed.
Figure 9B:
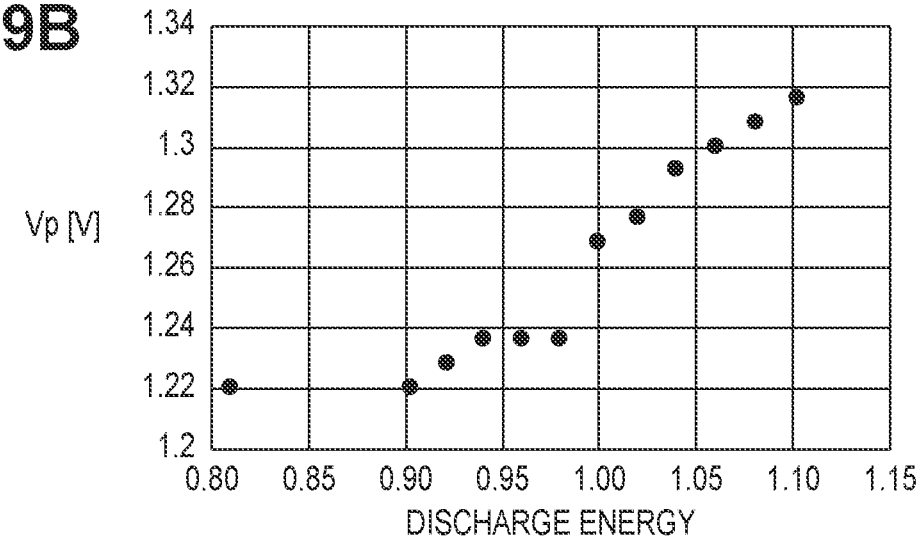
Figure 9C:
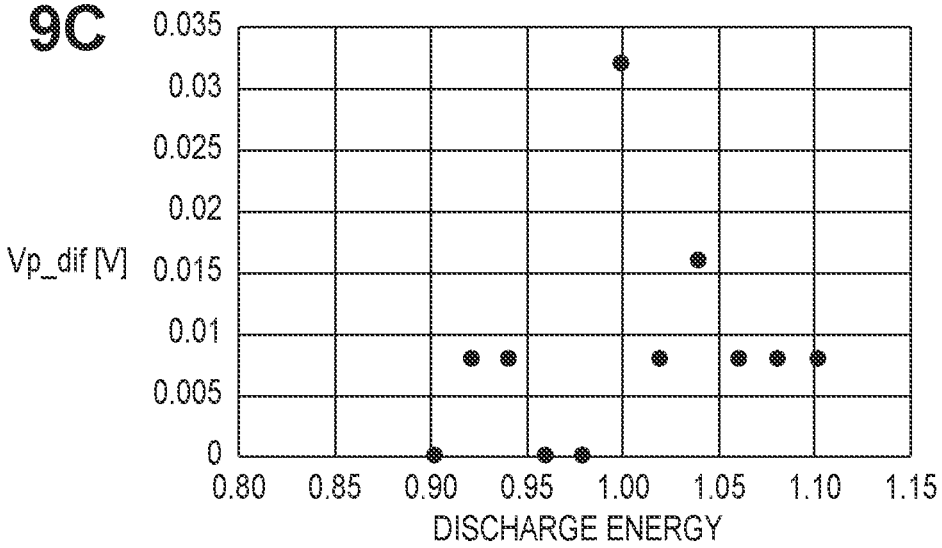

FIGS. 9A to 9C are views showing the profiles of the differential amplifier output Vdif and the peak voltage Vp of the output voltage when the discharge energy is changed. FIG. 9A shows the change of the output Vdif, and FIG. 9B shows the change of the peak voltage Vp of the output signal Vinv. The minimum energy confirmed when printing is actually performed by discharging ink onto the surface of a paper sheet is set as 1 (E=1.00) and represented in FIGS. 9A and 9B.

As shown in FIG. 9A, when the discharge energy is lower than 1 and no ink discharge is performed, the maximum temperature will also be low because the energy amount is small in the first place, and thus no feature point will appear. However, when the discharge energy becomes equal to or more than 1, the maximum temperature will also rise, and the feature point will appear. Hence, as shown in FIG. 9B, in the relationship between the discharge energy and the peak voltage Vp of the output signal Vinv, the peak voltage Vp begins to change greatly when E≥1.00 in contrast to the small change amount of the peak voltage Vp shown when E<1.00.

FIG. 9C shows, with respect to the 12 peak voltages Vp obtained by causing the discharge energy shown in FIG. 9B to change over the 11 steps from E=0.81 to 1.10, the relationship between the discharge energy and a difference Vp_dif with the peak voltage Vp of a preceding step. As is obvious from FIG. 9C, since the difference value changes greatly at E=1.00, the minimum discharge energy Eth can be measured by detecting this change. In the example shown in FIG. 9C, the minimum discharge energy Eth can be measured by setting the threshold to 20 mV. In this manner, the minimum discharge energy can be measured at a point where the difference Vp_dif is large. Hence, even if the peak voltage Vp to be measured and the differential amplifier output Vdif more or less change due to various kinds of external factors at the time of measurement, the influence on the detection result of the minimum discharge energy due to this change can be effectively minimized.

Figure 10:
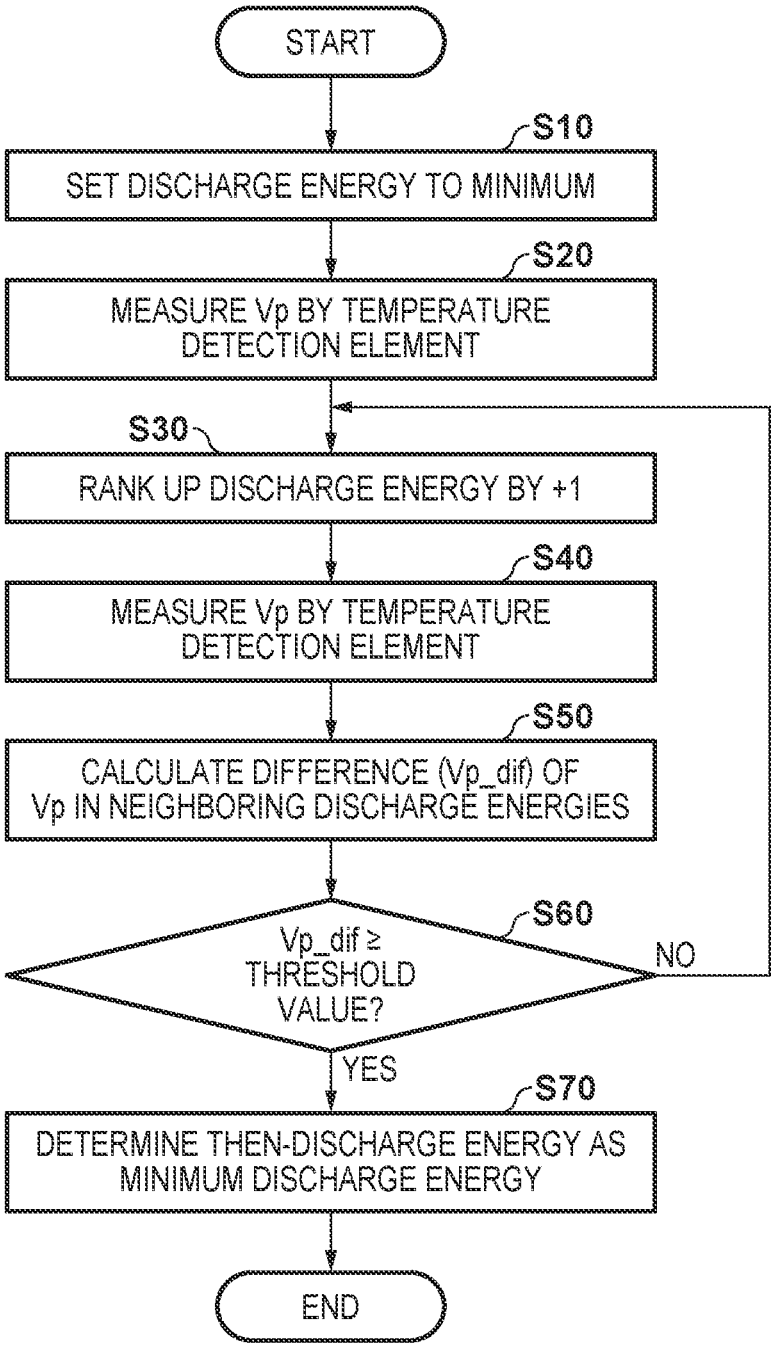
FIG. 10 is a flowchart showing processing for calculating minimum discharge energy Eth of ink according to the first embodiment.

FIG. 10 is a flowchart showing the processing for calculating the ink minimum discharge energy Eth by using the processes described above.

First, in step S10, the heater to be the target of minimum discharge energy measurement is determined, and the minimum discharge energy settable to this heater is set. Next, in step S20, the peak voltage Vp is measured by the temperature detection element 905. In addition, in step S30, the discharge energy is increased by one step (to be referred to by one level hereinafter), and the peak voltage Vp is measured again in step S40. Subsequently, in step S50, the difference Vp_dif between the peak voltage Vp of the current measurement and the peak voltage Vp of the preceding measurement is calculated, and whether the calculated value is equal to or more than the threshold (20 mV in the example shown in FIG. 9C) is checked in step S60.

If it is determined that the difference Vp_dif is equal to or more than the threshold, the process will advance to step S70 to set the discharge energy of the current time to be the minimum discharge energy, and the processing ends. In contrast, if it is determined that the difference Vp_dif is less than the threshold, the process will return to step S30, and the processes of steps S30 to S60 are repeated until the discharge energy which is equal to or more than the threshold is discovered.

Hence, according to the embodiment described above, it is possible to obtain the minimum discharge energy Eth of a heater by performing an actual measurement without receiving the influence from changes due to external factors.

Second Embodiment

When printing is to be performed actually by using a printhead, the same driving conditions tend to be applied to a plurality of heaters 15 from the point of executing high-speed discharge and the point of facilitating print control. In a case in which the plurality of heater 15 are to be manufactured, the actual energy amount to be generated will vary depending on the heater 15 even if the same driving conditions are provided because the resistance of the heater 15 will vary at the time of manufacture. Thus, in this case, optimum minimum discharge energy Eth of the plurality heaters 15 need to be measured under the same driving conditions.

This embodiment is applicable to a case in which the minimum discharge energy Eth of such plurality of heaters 15 is to be measured.

Figure 11A:
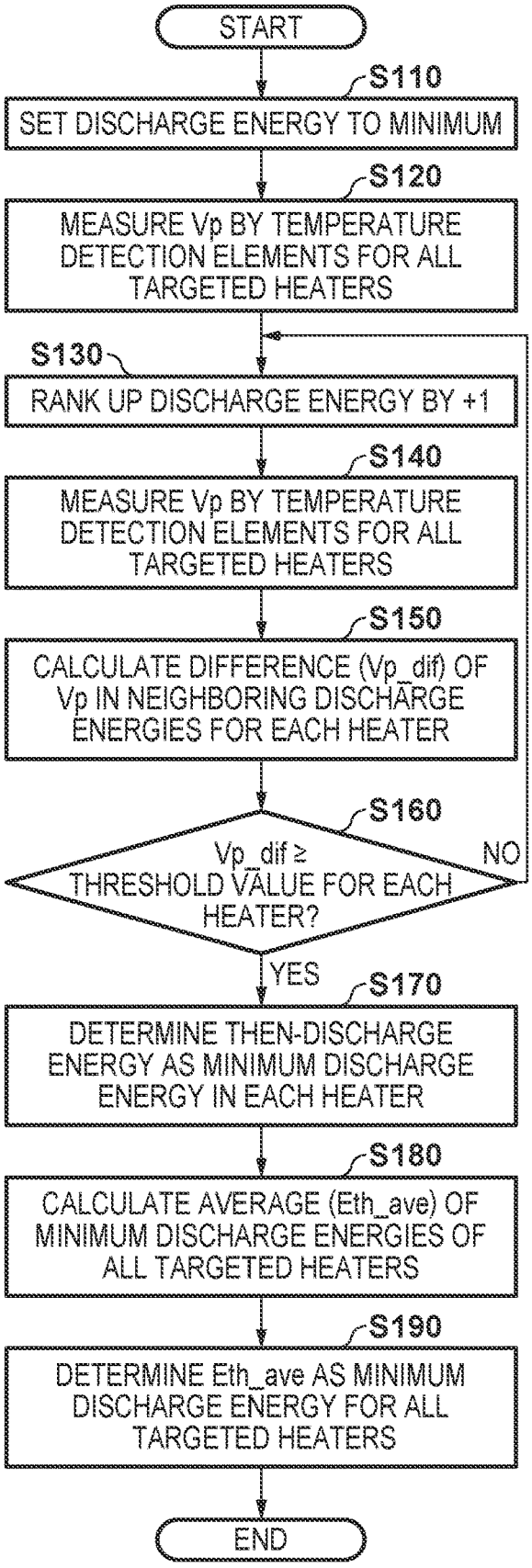
FIGS. 11A and 11B are flowcharts showing processing for calculating minimum discharge energy Eth of ink according to the second embodiment.
Figure 11B:
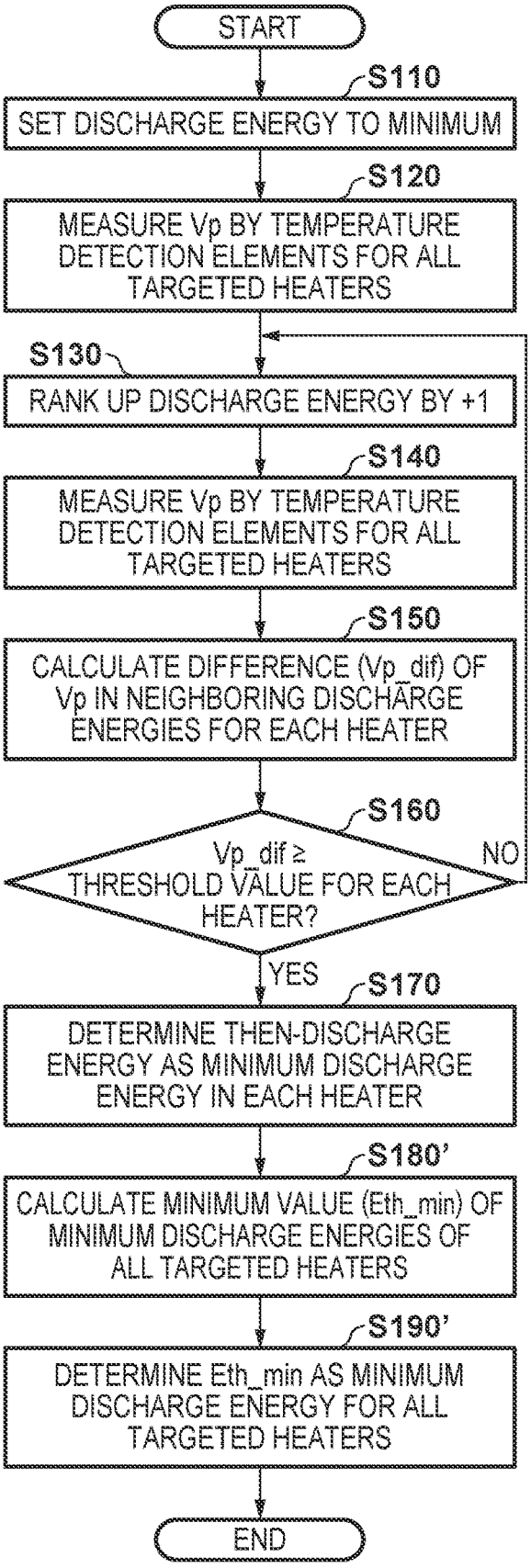

FIGS. 11A and 11B are flowcharts showing the processing for calculating the ink minimum discharge energy.

According to FIG. 11A, in step S110, the minimum discharge energy that can be set is set. Next, in step S120, peak voltages Vp of all of the targeted heaters are measured by corresponding temperature detection elements 905. The heaters to be set as targets in this case are, for example, a plurality of heaters that have been arranged into a group. As an example, the heaters may be arranged into four groups based on the respective color inks to be discharged, and all of the heaters of each group will be measured. In addition, in step S130, the discharge energy is increased by one step, and the peak voltages Vp of all of the heaters of the targeted group are measured again in step S140. In step S150, a difference Vp_dif between the peak voltage Vp of the current measurement and the peak voltage Vp of the preceding measurement is calculated for each heater, and in step S160, whether the calculated value of the difference Vp_dif is equal to or more than the threshold (20 mV in the example shown in FIG. 9C) is checked for each heater.

In this case, if it is determined that the difference Vp_dif of each heater is equal to or more than the threshold, the process advances to step S170 to set the discharge energy of the current time to be the minimum discharge energy. In contrast, if any one of the differences Vp_dif of the heaters is determined to be less than the threshold, the process will return to step S130, and the processes of steps S130 to S160 are repeated until the discharge energy that sets the difference Vp_dif of every heater to be equal to or more than the threshold is discovered.

Furthermore, in step S180, an average value Eth_ave of the minimum discharge energies of all of the heaters of the targeted group is calculated, and in step S190, the average value Eth_ave is set as the minimum discharge energy of every targeted heater.

As described above with reference to FIG. 11A, the peak voltages Vp of the plurality of heaters 15 are measured by the corresponding temperature detection elements 905 while changing the discharge energy to calculate the respective differences Vp_dif. Subsequently, the discharge energy in which the difference Vp_dif has exceeded the threshold for the first time is set as the minimum discharge energy for each heater 15, and the discharge energy obtained by averaging the minimum discharge energies of all of the targeted heaters 15 is set as the minimum discharge energy Eth_ave.

In this case, although a fraction can result from the averaging process, an approximate value of the discharge energy value settable in the printing apparatus can be selected. Also, although the minimum discharge energies of the heaters were averaged in the example shown in FIG. 11A, the median may be obtained. In a case in which the heater 15 which has an extreme discharge energy value is present, using the median has the effect of decreasing the influence from the discharge energy of this heater 15.

Additionally, instead of using an average value calculated after measuring the minimum discharge energies Eth of the plurality of heaters 15, the maximum value obtained among the minimum discharge energies of the plurality of heaters may be used. By using the maximum value, it becomes possible to set the discharge energy which will allow all of the measured heaters 15 to definitely perform a discharge operation, and the risk of discharge failure can be reduced.

Furthermore, as shown in FIG. 11B, there is also a method of using a minimum value Eth_min obtained among the minimum discharge energies of the plurality of heaters 15 that have been measured. According to FIG. 11B, after executing the processes of steps S110 to S170 in a manner like FIG. 11A, the minimum value Eth_min among the minimum discharge energies of all of the heaters of the targeted group is calculated in step S180'. Subsequently, in step S190', the minimum value Eth_min is set as the minimum discharge energy of every targeted heater.

In general, discharge energy obtained by multiplying a predetermined coefficient to the obtained minimum discharge energy Eth is used in the actual print operation. However, if excessive discharge energy is applied to each heater 15 in the actual print operation, damage to each heater 15 including an anti-cavitation film 910 will increase. This might influence the lifetime of each heater 15. Hence, by using, as the minimum discharge energy, the minimum value Eth_min of the minimum discharge energies of all of the heaters of the targeted group, the heaters 15 can be driven without the application of excessive discharge energy, and damage to the heaters can be minimized.

According to the embodiment as described above, it is possible to obtain suitable minimum discharge energy that is not influenced by external factors can be obtained for a plurality of heaters.

Third Embodiment

When minimum discharge energy Eth is to be measured, a peak voltage Vp may change due to noise in a circuit or the minimum discharge energy Eth itself may change due to the measurement environment such as the ink temperature or the like. A method of measuring the minimum discharge energy Eth more stably in such a state will be described in this embodiment.

Figure 12A:
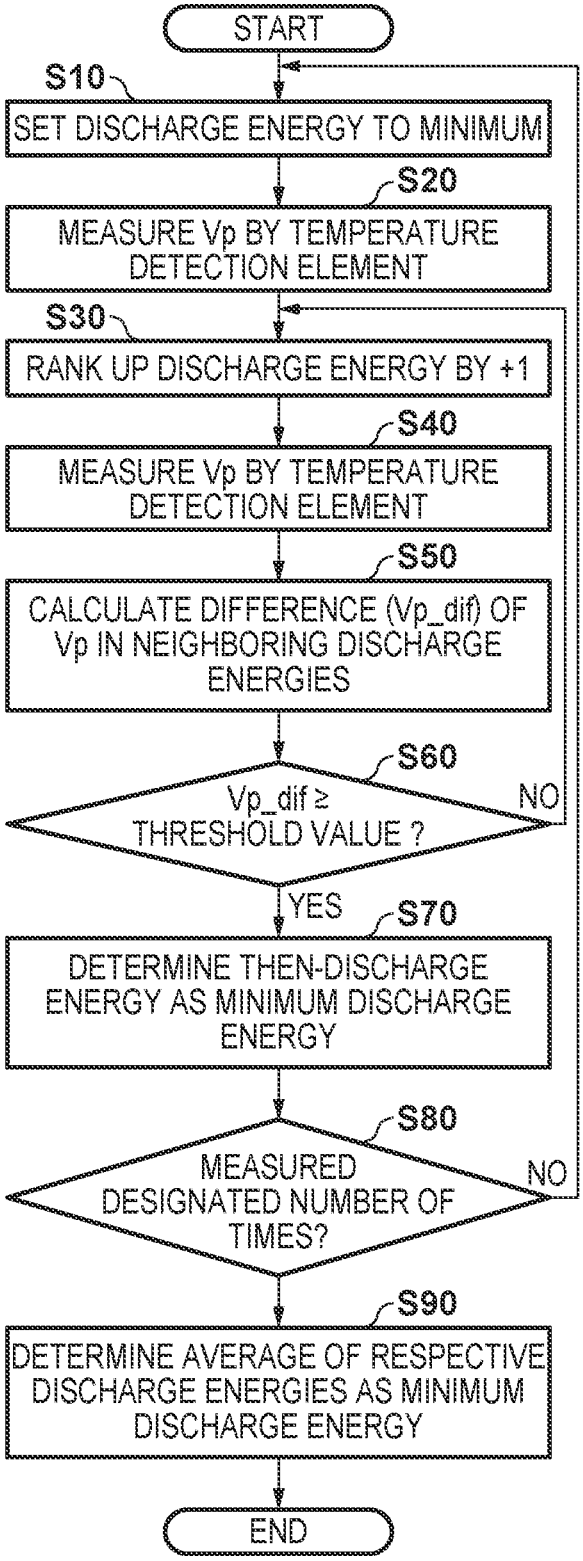
FIGS. 12A and 12B are flowcharts showing processing for calculating minimum discharge energy Eth of ink according to the third embodiment.
Figure 12B:
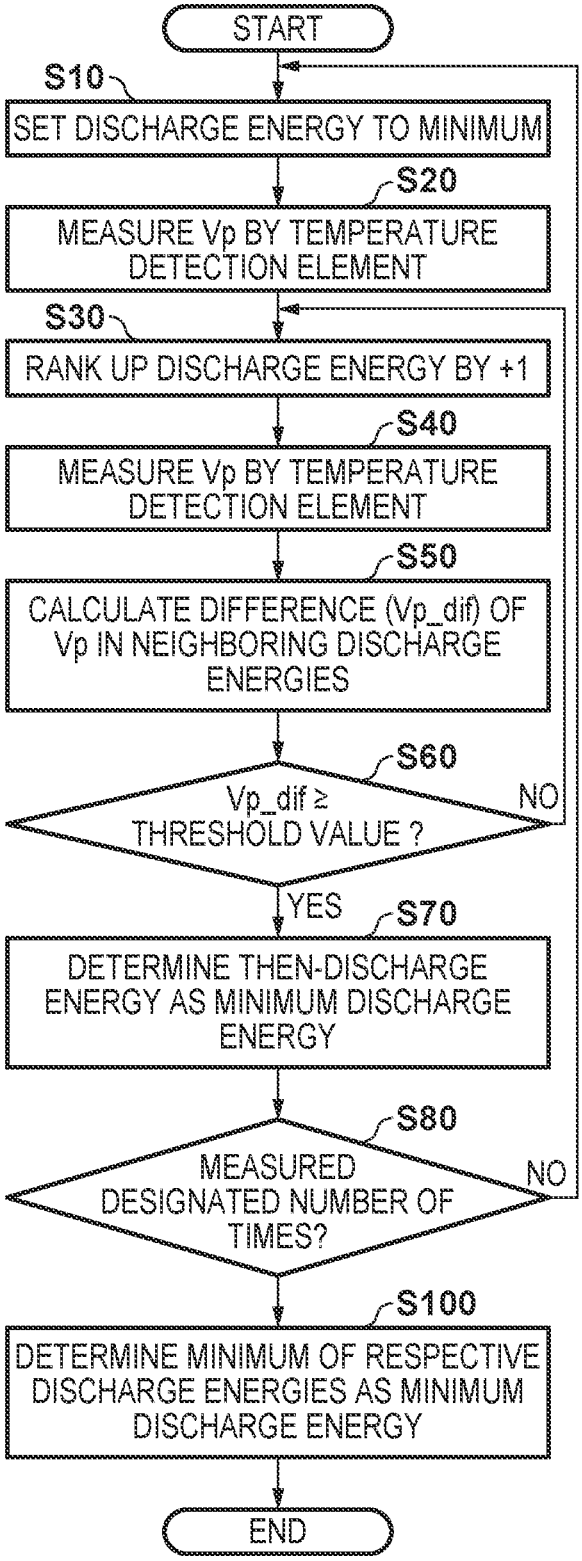

FIGS. 12A and 12B are flowcharts showing the processing for calculating the ink minimum discharge energy. Note that in FIGS. 12A and 12B, processing steps which are like those already described with reference to FIG. 10 in the first embodiment are denoted with the same reference numerals, and further description thereof will be omitted.

According to FIG. 12A, after the processes of steps S10 to S70 have been executed for one selected heater 15, whether a designated number of measurement operations have been performed for this heater is checked in step S80. In this case, if the measured number of measurement operations is less than the designated number of measurement operations, the process returns to step S10, and processing is performed for a designated number of times. In contrast, if the measured number of measurement operations has reached the designated number of measurement operations, the process advances to step S90. In step S90, the minimum discharge energies obtained in the respective measurement operations are averaged, and the obtained average value is set as the minimum discharge energy Eth.

As described above with reference to FIG. 12A, processing is executed so that the peak voltage Vp of one heater 15 is measured a plurality of times and the discharge energy at the time in which a difference Vp_dif exceeds a threshold for the first time is set as the minimum discharge energy Eth. Subsequently, the obtained measurement results are averaged, and the obtained average value is set as the minimum discharge energy Eth.

Hence, according to the embodiment described above, the minimum discharge energy Eth in which the influence of various kinds of variation factors has been removed can be measured by averaging the results obtained from performing measurement a plurality of times.

In addition, the maximum value may be used instead of averaging the results obtained from performing measurement a plurality of times. Using the maximum value can reduce the risk of discharge failure because it allows discharge energy that can almost always implement an ink discharge operation to be set.

Furthermore, as shown in FIG. 12B, it is also possible to set, as the minimum discharge energy Eth, the minimum value among the minimum discharge energy measurement results obtained from performing measurement a plurality of times. According to FIG. 12B, after executing the processes of steps S10 to S80 in a manner like FIG. 12A, the minimum value of the minimum discharge energies obtained from the respective measurement operations can be determined to be the minimum discharge energy Eth in step S100.

As described in the second embodiment, the applying excessive discharge energy on each heater 15 might increase the damage of the heater 15 including an anti-cavitation film 910, and this may influence the lifetime of the heater. Hence, using the minimum value will allow each heater 15 to be driven without applying excessive discharge energy to the heater 15, and the damage to the heater can be minimized.

Although the first to third embodiments have been described above, performing minimum discharge energy measurement will expend some time in any of the embodiments. During that period of time, evaporation of ink will proceed from each orifice, and the ink viscosity in the vicinity of the orifice may increase and inhibit the ink discharge, causing a state in which the minimum discharge energy cannot be measured suitably. Hence, in order to prevent the influence of the viscosity increase due to the evaporation of the ink, it is preferable for the ink to be circulated inside and outside of a pressure chamber 23 as shown in FIG. 6.

In addition, as another method of preventing the influence of the viscosity increase due to the evaporation of the ink, a preliminary discharge operation may be added immediately before the measurement of the minimum discharge energy Eth as described in the above embodiments. Since executing a preliminary discharge operation will fill the pressure chamber 23 with fresh ink at the time of the measurement of the minimum discharge energy Eth, the measurement operation can be performed more suitably.

Also, in a case in which the discharge energy is to be applied from the heater 15, a discharge energy E can be expressed as $$E = VH \times VH \times Pw / Rhe \tag{4}$$

where VH is a heater driving voltage, PW is a heater driving pulse length, and Rhe is a resistance of the heater 15. Thus, the discharge energy can be changed by changing one of the heater driving pulse length Pw and the constant voltage VH.

Furthermore, since the minimum discharge energy Eth described above is a limit value of an ink droplet discharge operation, the bubbling state may change due to, for example, slight changes in the temperature of the surrounding environment. Hence, it is preferable to multiply the obtained minimum discharge energy by a predetermined coefficient and set the resultant value as the minimum discharge energy to be used in the actual print operation.

Figure 13:
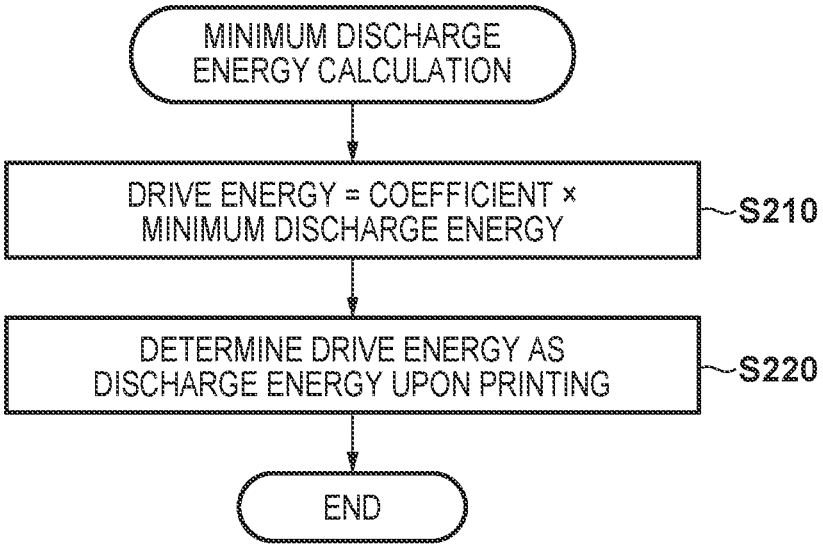
FIG. 13 is a flowchart showing processing for obtaining the driving energy to be used in an actual print operation.

FIG. 13 is a flowchart for obtaining the driving energy to be used in the actual print operation.

As shown in FIG. 13, in step S210, the discharge energy obtained by multiplying the minimum discharge energy Eth, obtained in one of the first to third embodiments by a predetermined coefficient, is used to drive the heaters in the actual print operation. In this embodiment, it is particularly preferable to use a value which falls in the range of 1.10 to 1.44 as this predetermined coefficient. Subsequently, in step S220, the discharge energy calculated in step S210 is determined to be the discharge energy to be used at the time of the actual print operation.

The processing described in the above embodiment may be executed during the actual print operation, for example, during a period until the print operation of the next print medium. However, since the printing time will be prolonged in such a case, it is preferable to execute the minimum discharge energy determination processing during a time in which the print operation is not being executed. For example, it is preferable to execute this processing at the time of a maintenance operation such as the printhead recovery operation or the like.

In addition, in the processing described in the above embodiment, it is possible to use a pulse to be described below as the driving pulse of each heater 15 when the minimum discharge energy is to be measured.

FIGS. 14A to 14D are charts showing the driving pulse to be used to determine the minimum discharge energy.

Figure 14A:
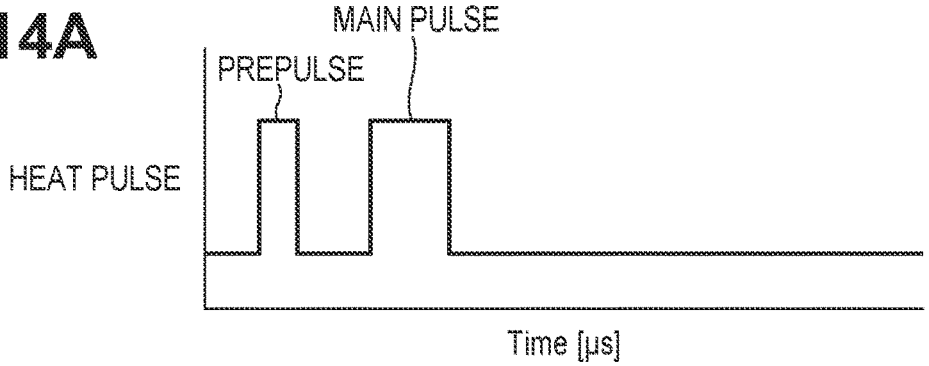
FIGS. 14A, 14B, 14C, and 14D are charts showing a driving pulse to be used for determining the minimum discharge energy.

Normally, in the thermal inkjet method, two kinds of pulses (double pulses), that is, a pre-pulse for applying heat which is for the purpose of ink discharge stabilization and is of a degree not capable of causing the ink to bubble at the time of printing, and a main pulse for actually causing the ink to bubble to perform the ink discharge operation are used as shown in FIG. 14A. Although ink discharge adjustment is performed by adjusting the pulse widths of the pre-pulse and the main pulse, such a double pulse arrangement need not be used if the discharge energies are equal when the above-described minimum discharge energy Eth is to be measured.

Figure 14B:
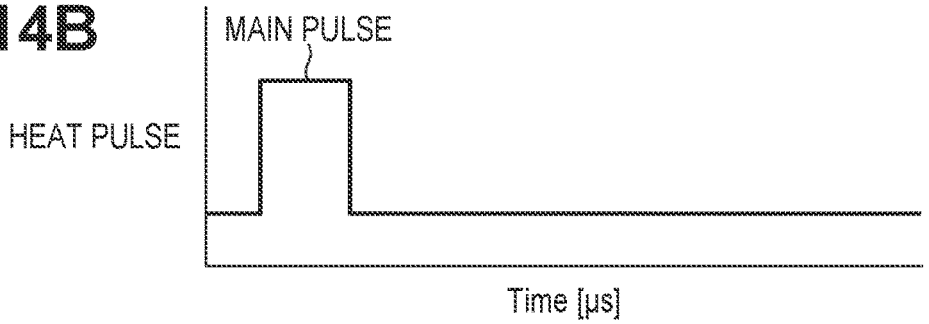
Figure 14C:
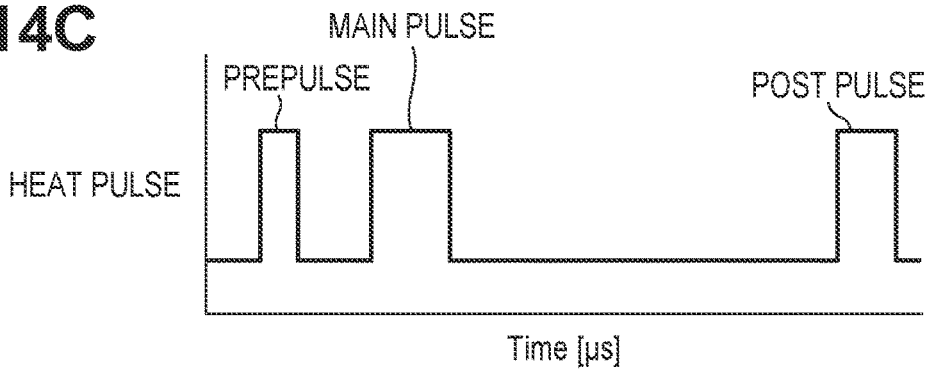
Figure 14D:
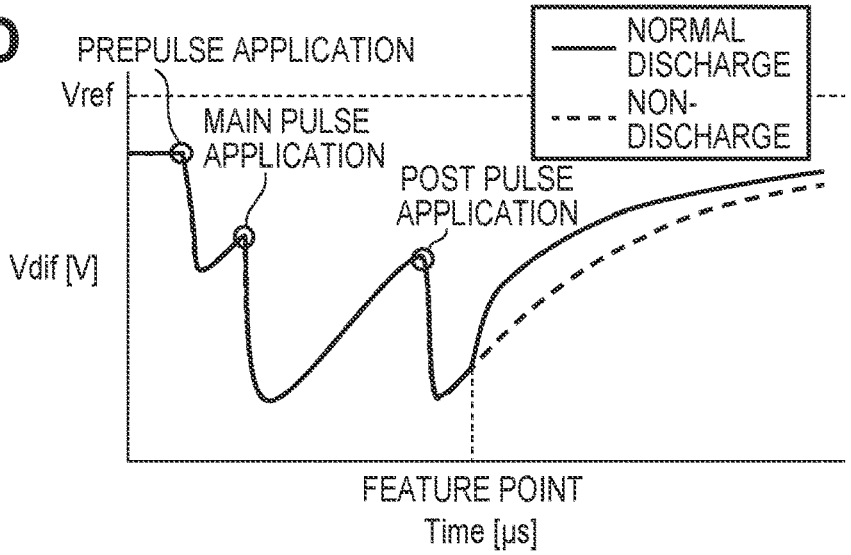

For example, a single pulse constituted by only the main pulse as shown in FIG. 14B may be applied or a pulse (post pulse) for enhancing a feature point after the main pulse may be applied as shown in FIG. 14C. It is preferable to apply the post pulse as shown in FIG. 14C immediately before a part of the discharged ink droplet falls on to each heater 15 by the contraction of the bubble after the bubbling. Since a relatively cold ink droplet will fall onto the heater 15 when the heater is hot, the temperature change of the heater 15 can be maximized. Accordingly, the feature point is emphasized in the manner shown in FIG. 14D, and the output difference of output signals Vinv is increased by the minimum discharge energy Eth and the discharge energy immediately before the minimum discharge energy Eth is reached in the measurement of the minimum discharge energy Eth. Accordingly, the minimum discharge energy Eth can be detected more easily. Note that since the output signal Vinv will decrease if the ink is made to bubble again, it is preferable to heat each heater 15 by applying the post pulse of a degree that will not cause the ink to bubble again.

In the embodiments described above, the peak voltage Vp was measured first at the time of the minimum discharge energy measurement by sequentially increasing the discharge energy from the settable minimum energy. However, the discharge energy to be supplied at the start of the measurement may be determined based on the minimum discharge energy Eth of a preceding measurement operation. For example, the measurement may be started from discharge energy which is five levels below the minimum dischargeable energy that was measured in the preceding operation. This can contribute to reducing the number of loops performed to search for the peak voltage Vp and shorten the measurement time. In like manner, the discharge energy change amount may initially be set not on a single level basis but on a multiple level basis, and a sequence in which only the voltages of the levels in the periphery of the peak voltage Vp will be measured on a single level basis may be executed. Either way, as long as the peak voltage Vp is obtained by changing the discharge energy, similar sequences can be applied without deviating from the spirit of the present disclosure.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-229207, filed Dec. 6, 2018, which is hereby incorporated by reference herein in its entirety.

What is claimed is:

1. A printing apparatus that performs printing by discharging ink onto a print medium from a printhead which includes a plurality of electrothermal transducers, a plurality of temperature detection elements configured to detect temperatures of corresponding electrothermal transducers, and a plurality of orifices arranged in correspondence with the plurality of electrothermal transducers, comprising:

a measurement unit configured to use a corresponding temperature detection element to measure a temperature, which changes due to heat generated by supplying energy, of an electrothermal transducer selected from the plurality of electrothermal transducers;

a detection unit configured to detect, based on the temperature measured by the measurement unit, a peak voltage which indicates a point of change, from a state in which the ink is discharged normally from the printhead to a state in which the ink is not discharged from the printhead, and which is based on an output signal from the temperature detection element reflecting temperature change of the electrothermal transducer;

a comparison unit configured to compare the peak voltage detected by the detection unit with a threshold value;

a change unit configured to change the energy to be supplied to the selected electrothermal transducer;

a repetition unit configured to repeat the measurement by the measurement unit, the detection by the detection unit, and the comparison by the comparison unit, by supplying the energy changed by the change unit, until the peak voltage is determined not to be less than the threshold value in the comparison by the comparison unit; and a determination unit configured to determine the energy supplied at a time in which the peak voltage is determined not to be less than the threshold to be minimum discharge energy.

2. The apparatus according to claim 1, further comprising an averaging unit configured to average the minimum discharge energies of the respective electrothermal transducers obtained by executing the measurement by the measurement unit, the detection by the detection unit, and the comparison by the comparison unit on the plurality of electrothermal transducers, wherein the determination unit determines an average value obtained by the averaging unit as the minimum discharge energy of the plurality of electrothermal transducers.

3. The apparatus according to claim 1, further comprising a calculation unit configured to calculate a minimum value of the minimum discharge energies of the respective electrothermal transducers obtained by executing the measurement by the measurement unit, the detection by the detection unit, and the comparison by the comparison unit on the plurality of electrothermal transducers, wherein the determination unit determines the minimum value obtained by the calculation unit to be the minimum discharge energy of the plurality of electrothermal transducers.

4. The apparatus according to claim 1, further comprising a calculation unit configured to calculate a maximum value of the minimum discharge energies of the respective electrothermal transducers obtained by executing the measurement by the measurement unit, the detection by the detection unit, and the comparison by the comparison unit on the plurality of electrothermal transducers, wherein the determination unit determines the maximum value obtained by the calculation unit to be the minimum discharge energy of the plurality of electrothermal transducers.

5. The apparatus according to claim 1, further comprising an averaging unit configured to average the minimum discharge energies obtained for respective execution operations performed on the selected electrothermal transducer by executing the measurement by the measurement unit, the detection by the detection unit, and the comparison by the comparison unit on the selected electrothermal transducer over a plurality of times, wherein the determination unit determines an average value obtained by the averaging unit as the minimum discharge energy.

6. The apparatus according to claim 1, further comprising a calculation unit configured to calculate a minimum value of the minimum discharge energies obtained for respective execution operations performed on the selected electrothermal transducer by executing the measurement by the measurement unit, the detection by the detection unit, and the comparison by the comparison unit on the selected electrothermal transducer over a plurality of times, wherein the determination unit determines the minimum value obtained by the calculation unit to be the minimum discharge energy.

7. The apparatus according to claim 1, further comprising a calculation unit configured to calculate a maximum value of the minimum discharge energies obtained for respective execution operations performed on the selected electrothermal transducer by executing the measurement by the measurement unit, the detection by the detection unit, and the comparison by the comparison unit on the selected electrothermal transducer over a plurality of times, wherein the determination unit determines the maximum value obtained by the calculation unit to be the minimum discharge energy.

8. The apparatus according to claim 1, wherein the determination of the minimum discharge energy is performed during a print operation.

9. The apparatus according to claim 1, wherein the determination of the minimum discharge energy is performed when a print operation is not performed.

10. The apparatus according to claim 1, further comprising:

an ink tank configured to supply ink to the printhead;

a sub-tank connected between the ink tank and the printhead; and a circulation unit configured to circulate the ink between the sub-tank and the printhead.

11. The apparatus according to claim 10, wherein the printhead includes:

a first fluid channel configured to supply ink to each of the plurality of electrothermal transducers; and a second fluid channel configured to collect the ink from each of the plurality of electrothermal transducers.

12. The apparatus according to claim 1, wherein the change unit changes the energy to be supplied by changing a pulse width of a pulse to be applied on the electrothermal transducer.

13. The apparatus according to claim 12, wherein the change unit sequentially changes the energy to be supplied from largest energy to smallest energy or from the smallest energy to the largest energy.

14. The apparatus according to claim 1, wherein energy obtained by multiplying the minimum discharge energy determined by the determination unit by a predetermined coefficient is set as discharge energy to be used in an actual print operation.

15. The apparatus according to claim 1, wherein the printhead is a full-line printhead.

16. The apparatus according to claim 1, wherein a profile of the temperature change is different for a case in which the ink is discharged normally from the printhead and for a case in which the ink is not discharged from the printhead, and the peak voltage will change if the energy to be supplied is different even in the case in which the ink is discharge normally from the printhead.

17. The apparatus according to claim 16, wherein in a case in which the energy to be supplied has been changed, the change in the peak voltage will be largest in the minimum discharge energy.

18. A method of determining minimum discharge energy of a printing apparatus that performs printing by discharging ink onto a print medium from a printhead which includes a plurality of electrothermal transducers, a plurality of temperature detection elements configured to detect temperatures of corresponding electrothermal transducers, and a plurality of orifices arranged in correspondence with the plurality of electrothermal transducers, the method comprising:

using a corresponding temperature detection element to measure a temperature, which changes due to heat generated by supplying energy, of an electrothermal transducer selected from the plurality of electrothermal transducers;

detecting, based on the measured temperature, a peak voltage which indicates a point of change, from a state in which the ink is discharged normally from the printhead to a state in which the ink is not discharged from the printhead, and which is based on an output signal from the temperature detection element reflecting temperature change of the electrothermal transducer;

comparing the detected peak voltage with a threshold value;

changing the energy to be supplied to the selected electrothermal transducer;

repeating the measurement, the detection, and the comparison, by supplying the changed energy until the peak voltage is determined not to be less than the threshold value in the comparison; and determining the energy supplied at a time in which the peak voltage is determined not to be less than the threshold to be minimum discharge energy.

* * * * *